US008610750B2

(12) United States Patent
Liu et al.

(10) Patent No.: US 8,610,750 B2
(45) Date of Patent: Dec. 17, 2013

(54) PRINT HEAD PULSING TECHNIQUES FOR MULTICOLOR PRINTERS

(71) Applicant: Zink Imaging, Inc., Waltham, MA (US)

(72) Inventors: Chien Liu, Wayland, MA (US); William T. Vetterling, Lexington, MA (US)

(73) Assignee: Zink Imaging, Inc., Waltham, MA (US)

( * ) Notice: Subject to any disclaimer, the term of this patent is extended or adjusted under 35 U.S.C. 154(b) by 0 days.

(21) Appl. No.: 13/927,368

(22) Filed: Jun. 26, 2013

(65) Prior Publication Data

US 2013/0286135 A1 Oct. 31, 2013

Related U.S. Application Data

(63) Continuation of application No. 13/423,868, filed on Mar. 19, 2012, now Pat. No. 8,502,846, which is a continuation of application No. 12/940,845, filed on Nov. 5, 2010, now Pat. No. 8,164,609, which is a continuation of application No. 11/159,880, filed on Jun. 23, 2005, now Pat. No. 7,830,405.

(51) Int. Cl.
*B41J 2/32* (2006.01)

(52) U.S. Cl.
USPC ..... 347/175; 347/188; 347/211

(58) Field of Classification Search
USPC ..... 347/171, 172, 188, 211, 175
See application file for complete search history.

(56) References Cited

U.S. PATENT DOCUMENTS

| | | | | |
|---|---|---|---|---|
| 7,830,405 | B2 * | 11/2010 | Liu et al. | 347/211 |
| 8,164,609 | B2 * | 4/2012 | Liu et al. | 347/211 |
| 2012/0176459 | A1 * | 7/2012 | Liu et al. | 347/211 |

* cited by examiner

*Primary Examiner* — Huan Tran
(74) *Attorney, Agent, or Firm* — Foley & Lardner LLP; Michael Morency

(57) ABSTRACT

In one aspect of the invention there is disclosed a multicolor thermal imaging system wherein different heating elements on a thermal print head can print on different color-forming layers of a multicolor thermal imaging member in a single pass. The line-printing time is divided into portions, each of which is divided into a plurality of subintervals. All of the pulses within the portions have the same energy. In one embodiment, every pulse has the same amplitude and duration. Different colors are selected for printing during the different portions by varying the fraction of subintervals that contain pulses. This technique allows multiple colors to be printed using a thermal print head with a single strobe signal line. Pulsing patterns may be chosen to reduce the coincidence of pulses provided to multiple print head elements, thereby reducing the peak power requirements of the print head.

20 Claims, 20 Drawing Sheets

PRINT HEAD PULSING TECHNIQUES FOR MULTICOLOR PRINTERS

CROSS REFERENCE TO RELATED APPLICATIONS

The present application claims the benefit of priority to and is a continuation of co-pending U.S. patent application Ser. No. 13/423,868, filed on Mar. 19, 2012; which is a continuation of U.S. patent application Ser. No. 12/940,845, filed on Nov. 5, 2010, issued on Apr. 24, 2012 as U.S. Pat. No. 8,164,609; which is a continuation of U.S. patent application Ser. No. 11/159,880, filed on Jun. 23, 2005, issued on Nov. 9, 2010 as U.S. Pat. No. 7,830,405, each of which are incorporated by reference herein in their entirety, and is related to the following commonly assigned applications and patents, which are incorporated by reference herein in their entirety:

U.S. patent application Ser. No. 10/374,847, filed on Feb. 25, 2003, entitled "Image Stitching for a Multi-Head Printer";

U.S. patent application Ser. No. 10/151,432, filed on May 20, 2002, entitled "Thermal Imaging System", now U.S. Pat. No. 6,801,233;

U.S. patent application Ser. No. 10/990,672, entitled "Method and Apparatus for Controlling the Uniformity of Print Density of a Thermal Print Head Array"; and U.S. Pat. No. 6,661,443 to Bybell and Thornton, issued on Dec. 9, 2003, entitled "Method and Apparatus for Voltage Correction."

BACKGROUND

1. Field of the Invention

The present invention relates generally to a digital printing system and, more generally, to techniques for pulsing energy to print heads in a printer.

2. Related Art

Referring to FIG. 16, a block diagram of a thermal printing system 1600 is shown which illustrates features common to many thermal printing systems. A thermal printer 1602 typically contains one or more print heads 1604*a-b*, which contain linear arrays of heating elements 1606*a-h* (also referred to herein as "print head elements") that print on an output medium 1608 by, for example, transferring pigment or dye from a donor sheet to the output medium 1608 or by activating a color-forming chemistry in the output medium 1608. The output medium 1608 is typically a porous receiver receptive to the transferred pigment, or a paper coated with the color-forming chemistry. Each of the print head elements 1606*a-h* (which may number in the hundreds per inch), when activated, forms color on the portion of the medium 1608 passing underneath the print head element, creating a spot having a particular density. Regions with larger or denser spots are perceived as darker than regions with smaller or less dense spots. Digital images are rendered as two-dimensional arrays of very small and closely-spaced spots.

A thermal print head element is activated by providing it with energy. Providing energy to the print head element increases the temperature of the print head element, causing either the transfer of pigment to the output medium or the formation of color in the output medium. The density of the output produced by the print head element in this manner is a function of the amount of energy provided to the print head element. The amount of energy provided to the print head element may be varied by, for example, varying the amount of power provided to the print head element within a particular time interval or by providing power to the print head element for a longer or shorter time interval.

Some conventional methods for color thermal imaging, such as thermal wax transfer printing and dye-diffusion thermal transfer, involve the use of separate donor and receiver materials. The donor material typically has a colored image-forming material, or a color-forming imaging material, coated on a surface of a substrate and the image-forming material or the color-forming imaging material is transferred thermally to the receiver material (i.e., the output medium 1608). In order to make multicolor images, a donor material with successive patches of differently-colored, or different color-forming, material may be used. In the case of printers having either interchangeable cassettes or more than one thermal head, different monochrome donor ribbons are utilized and the multiple color planes of the image are printed successively above one another. The use of donor members with multiple different color patches or the use of multiple donor members increases the complexity and the cost, and decreases the convenience, of such printing systems. It would be simpler to have a single-sheet imaging member that has the entire multicolor imaging system embodied therein.

In International Application No. PCT/US02/15868 (which corresponds to U.S. patent application Ser. No. 10/151,432, cross-referenced above), entitled "Thermal Imaging System," there is described a direct thermal imaging system in which one or more of the thermal print heads 1604*a-b* can write two colors in a single pass on the single print medium 1608. The printer 1602 can write these multiple colors by addressing two or more image-forming layers of the output medium 1608 at least partially independently from the same surface so that each color can be printed alone or in selectable proportion with the other color(s).

The above-referenced patent application discloses an electronic pulsing technique that makes this result possible without modulating the heating element power supply voltage. Generally, each line printing time is divided into many subintervals. For example, referring to FIG. 1, a graph 100 is shown which plots the voltage across a single print head element (such as any one of print head elements 1606*a-h*) over time. Line interval 104 is subdivided into a plurality of subintervals 106*a-g*. In each of the subintervals, each print head heating element (also referred to herein simply as a "print head element") potentially receives an electrical pulse. In the particular example illustrated in FIG. 1, pulses 110*a-d* are provided in each of subintervals 106*a-d*.

Furthermore, the line printing time 104 can be divided into two segments, each containing a portion of the subintervals, as shown by the graph 200 in FIG. 2. Line interval 204 is divided into two segments 208*a* and 208*b*. The first segment 208*a* includes subintervals 206*a-g* and the second segment includes subintervals 206*h-v*. The pulses 210*a-d* in the first segment 208*a* are given a larger pulse duty cycle (the pulse duty cycle being the fraction of a subinterval during which power is applied) than the pulses 210*e-p* in the second segment 208*b*. The pulse duty cycle determines the average power being applied to the print head element during the segment and is used to select a particular one of the image-forming layers in the output medium 1608, and therefore to select a particular color to print.

In some instances this method for controlling the print head may not be completely satisfactory. For example, in wide format thermal printers in which multiple print heads are used in tandem to provide a wider format print it has been found to be advantageous to employ "screening" techniques when stitching together the image segments from each print head to form the final wider print. Examples of techniques for performing such stitching are disclosed in the above-referenced patent application entitled "Image Stitching for a Multi-Head Printer." It is not, however, possible to accomplish effective screening using the pulse patterns just described with conventional thermal print heads.

The reason for this difficulty is that a conventional thermal print head typically has one or a small number of "strobe" signal(s) that service(s) all print head elements in the print head. The strobe signal determines the pulse duty cycle, and as a consequence all or a significant fraction of the print head elements 1606*a-d* in print head 1604*a* have the same pulse duty cycle in each subinterval; similarly, all or a significant fraction of the print head elements 1606*e-h* in print head 1604*b* have the same pulse duty cycle in each subinterval. The pulse duty cycle, in turn, determines the image-forming layer being printed, as described in the above-referenced patent application entitled "Thermal Imaging System," and therefore it follows that during each subinterval all or a significant fraction of heating elements 1606*a-d* are printing on the same image-forming layer of the output medium 1608. Therefore, at any moment in time all or a significant fraction of the heating elements 1606*a-d* are printing the same color. This condition precludes the use of screening patterns that call for some of the heating elements 1606*a-d* to be printing on one image-forming layer (and therefore printing one color) while other ones of the heating elements 1606*a-d* are printing on another image-forming layer (and therefore printing another color).

It has been found, however, that some useful screening patterns require the print heads 1604*a-b* to print in just this way. For example, in the above-referenced patent application entitled "Image Stitching for a Multi-Head Printer," there is described a screening technique for use with a method for stitching image segments to make the stitching method more insensitive to any misregistration of the dots. In general, the technique disclosed therein introduces a pattern of time delays into the rows of the image so that the pixels do not lie on a rectangular grid. Instead, the pixels in a row have a repeated pattern of displacements from the nominal (default) position of the row in the transport direction ("down-web"). In one embodiment, for example, the first pixel in the row is undisplaced, the second pixel is displaced down-web by ⅓ of a row spacing, the third is displaced by ⅔ of a row spacing, the fourth is undisplaced, and the pattern repeats. There are, then, three types of pixels in the row. The first, fourth, seventh, etc., are undisplaced pixels, the second, fifth, eighth, etc., are displaced down-web by ⅓ of a row and the third, sixth, ninth, etc., are displaced down-web by ⅔ of a row.

The use of such patterns may reduce the dependence of printing density in the stitch on the registration of the pixels. Furthermore, such patterns can be used to improve the tolerance to misregistration of colored dots formed on an imaging medium that has multiple superimposed color-forming layers in different planes, such as where one or more color-forming layers are arranged on a first side of a transparent substrate and at least one color-forming layer is arranged on a second side of the substrate. However, the down-web displacement of the pixels may cause the first time segment of some pixels to overlap the second time segment of others, requiring that some pixels be supplied with a low duty-cycle strobe pulse at the same time that others are being supplied with a high duty-cycle strobe pulse. As described above, the use of a single or a small number of strobe signal(s) for all print head elements in a print head may make it impossible to provide such varying pulse duty cycles across print head elements in the same subinterval. What is needed, therefore, are improved techniques for performing screening in a printer that can write two colors in a single pass on a single print medium.

Note further that power is typically provided simultaneously to multiple print head elements in a print head. Ordinarily, the printer power supply is chosen to satisfy the "worst case" demand represented by the supply of power to all of the print head elements simultaneously. This typically results in the choice of a larger and more expensive power supply than would be required to fulfill the "average" power demand. Power supplies may be chosen to satisfy this peak power requirement even when the average power provided to the print head elements is low, as is the case, for example, when there are repeated segments with low duty-cycle printing. What is further needed, therefore, are improved techniques for performing screening in a printer to reduce the peak power requirements.

SUMMARY

In one aspect of the invention there is disclosed a multicolor thermal imaging system wherein different heating elements on a thermal print head can print on different color-forming layers of a multicolor thermal imaging member in a single pass. The line-printing time is divided into portions, each of which is divided into a plurality of subintervals. All of the pulses within the portions have the same energy. In one embodiment, every pulse has the same amplitude and duration. Different colors are selected for printing during the different portions by varying the fraction of subintervals that contain pulses. This technique allows multiple colors to be printed using a thermal print head with a single strobe signal line. Pulsing patterns may be chosen to reduce the coincidence of pulses provided to multiple print head elements, thereby reducing the peak power requirements of the print head.

Other features and advantages of various aspects and embodiments of the present invention will become apparent from the following description and from the claims.

DETAILED DESCRIPTION

In one aspect of the invention there is disclosed a multicolor thermal imaging system wherein different heating elements on a thermal print head can print on different color-forming layers of a multicolor thermal imaging member in a single pass. The line-printing time is divided into portions, each of which is divided into a plurality of subintervals. All of the pulses within the portions have the same energy. In one embodiment, every pulse has the same amplitude and duration. Different colors are selected for printing during the different portions by varying the fraction of subintervals that contain pulses. This technique allows multiple colors to be printed using the same strobe pulses. Pulsing patterns may be chosen to reduce the coincidence of pulses provided to multiple print head elements, thereby reducing the peak power requirements of the print head.

Figure 3:
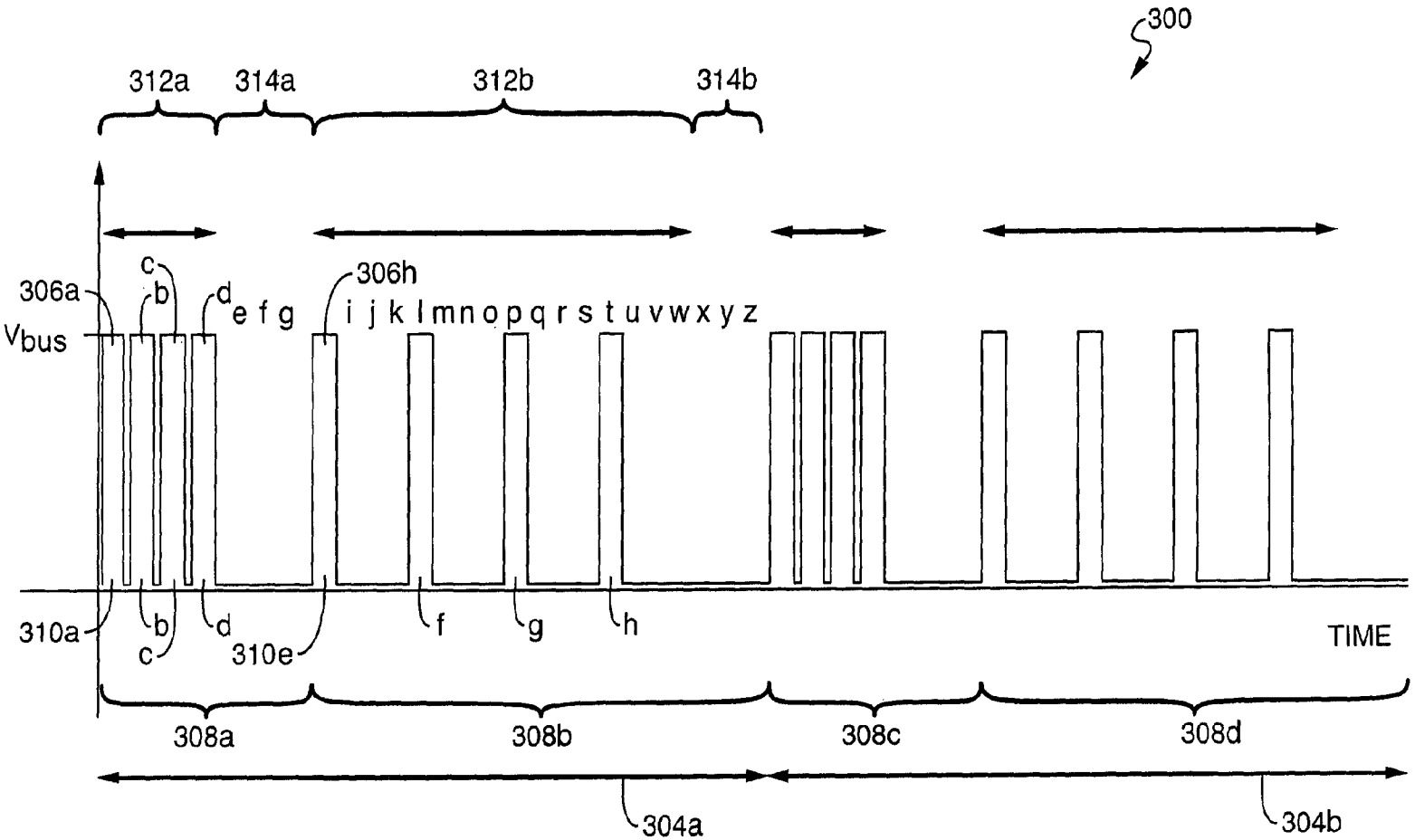
FIG. 3 is a graph that shows the voltage across a print head element over time in a printer in which the line time is divided into two segments, and in which pulses are provided periodically in one portion of the second segment according to one embodiment of the present invention.

For example, referring to FIG. 3, a graph 300 is shown which plots the voltage across a single print head element over time according to one embodiment of the present invention. Line interval 304*a* is divided into two segments 308*a* and 308*b*. Each of the segments 308*a-b* is further subdivided into an on-time and an off-time. More specifically, segment 308*a* is divided into on-time 312*a* and off-time 314*a*, and segment 308*b* is divided into on-time 312*b* and off-time 314*b*. No pulses are provided in the off-time of a segment. Pulses may be provided during the on-time of a segment. Although in the example illustrated in FIG. 3, each of the segments 308*a-b* contains a single on-time followed by a single off-time, this is not a requirement of the present invention. Segments may include other numbers of on-times and off-times arranged in orders other than that shown in FIG. 3.

Each of the on-times 312*a-b* is an example of a "portion" of the line interval 304*a*, as that term is used herein. Note that a segment need not include an off-time. In other words, the on-time of a segment may be the entire segment, in which case the term "portion" also refers to the entire segment. Likewise, a given segment need not include an on-time. A segment may include multiple portions, alternating between on-time and off-time portions.

Line interval 304*a* includes pulses 310*a-h*, all of which have the same energy. In the particular example illustrated in FIG. 3, all of the pulses 310*a-h* have the same amplitude and duration, although this is not required. Note further that the amplitude of all of the pulses 310*a-h* is the maximum (100%) voltage $V_{bus}$. Note, however, that this is not a requirement of the present invention.

Segment 308*a* is divided into subintervals 306*a-g*. Portion 312*a* contains subintervals 306*a-d* and portion 314*a* contains subintervals 306*e-g*. Pulses 310*a-d* having the same energy are provided in portion 312*a* of the first segment 308*a*. Although in the particular example illustrated in FIG. 3, pulses are provided in all of the subintervals 306*a-d* in the on-time portion 312*a* of segment 308*a*, this is not required. Rather, pulses may be provided in fewer than all of the subintervals 306*a-d* in the on-time portion 312*a* in any pattern. In general, the pulsing pattern, the voltage $V_{bus}$, and the duration of the pulses 310*a-d* may be chosen so that the average power in the first on-time portion 312*a* selects a first one of the color-forming layers in the output medium 1608 for printing.

Segment 308*b* is divided into subintervals 306*h-z*. In the second segment 308*b*, on-time portion 312*b* contains subintervals 306*h-w* and off-time portion 314*b* contains subintervals 306*x-z*. In the particular example illustrated in FIG. 3, pulses 310*e-h* having the same energy are provided in subintervals 306*h*, 306*l*, 306*p*, and 306*t*. In particular, pulses 310*e-h* are provided periodically in only one out of every four of the subintervals 306*h-w* (i.e., in subintervals 306*h*, 306*l*, 306*p*, and 306*t*). In the remaining subintervals 306*i-k*, 306*m-o*, 306*q-s*, and 306*u-w* of portion 312*b*, no pulses are provided. In general, the pulsing pattern, the voltage $V_{bus}$, and the duration of the pulses 310*e-h* may be chosen so that the average power in the second on-time portion 312*b* selects a second one of the color-forming layers in the output medium 1608 for printing. Note that although pulses are provided periodically in portion 312*b*, this is not required. Rather, pulses may be provided in any suitable pattern in portion 312*b*, as will be described in more detail below.

Although in the example illustrated in FIG. 3, the on-time portions 312*a* and 312*b* occupy the leading subintervals 306*a-d* and 306*h-w* of the first and second segments 308*a-b*, respectively, this is not required. Rather, the on-time portion of a segment may occupy subintervals of the segment other than those illustrated in FIG. 3.

Since the thermal time constant of the print head is typically much longer than the length of one of the subintervals 306*a-z*, the average power in portion 312*b* of the second segment 308*b* is approximately ¼ of the average power in portion 312*a* of the first segment 308*a*. In other words, the average power in the portion 312*b* is reduced not by varying the duration of individual pulses but by selecting the fraction of subintervals in the portion 312*b* in which the print head element is pulsed. The average power provided in the first on-time portion 312*a* thereby selects a first one of the color-forming layers in the output medium 1608 for printing, while the average power provided in the second on-time portion 312*b* thereby selects a second one of the color-forming layers in the output medium 1608 for printing.

Note that the scheme described above with respect to FIG. 3 still uses "duty cycle" as the means of modulating the power provided to the print head. The scheme illustrated by FIG. 3, however, modulates duty cycle at a coarser level than techniques that modulate duty cycle at the level of individual pulses. More specifically, the scheme illustrated in FIG. 3 modulates duty cycle by adjusting the fraction of pulses that are provided during a segment portion, rather than by adjusting the pulse duty cycle of individual pulses. This difference allows the same pulse duration to be used in both of the segments 308*a-b*, and therefore enables the same strobe pulse to be used in both segments 308*a-b* (and therefore to be used to print multiple colors).

This, in turn, enables arbitrary time delays to be applied to pixels printed during the line times 304*a-b*, allowing screening to be applied to the image to improve the joining of image segments, to reduce the effect of misregistration of images printed on the front and back sides of a transparent substrate, or to reduce the peak power demand of the printer. To understand how the modulation of average power using selective pulsing enables screening to be performed, recall that in the above-referenced patent application entitled "Image Stitching for a Multi-Head Printer," screening techniques are disclosed in which print head elements printing different colors may be active at the same time. In systems in which multiple colors are printed by varying the average power provided to print head elements, printing multiple colors at the same time requires the ability to provide different average power levels to different print head elements at the same time. It is not possible to achieve this result by varying the pulse duty cycle of individual pulses in systems that use a single pulse strobe signal. The techniques disclosed above, however, enable the average power provided to a print head element to be varied by varying the fraction of pulses provided to the print head element in a given time period, even when all pulses share the same pulse duty cycle as dictated by the use of a single strobe signal. The techniques disclosed herein therefore enable screening techniques, such as those disclosed in the above-referenced patent application entitled "Image Stitching for a Multi-Head Printer," to be used even in multicolor printers that use a single pulse strobe signal for each print head.

Figure 4A:
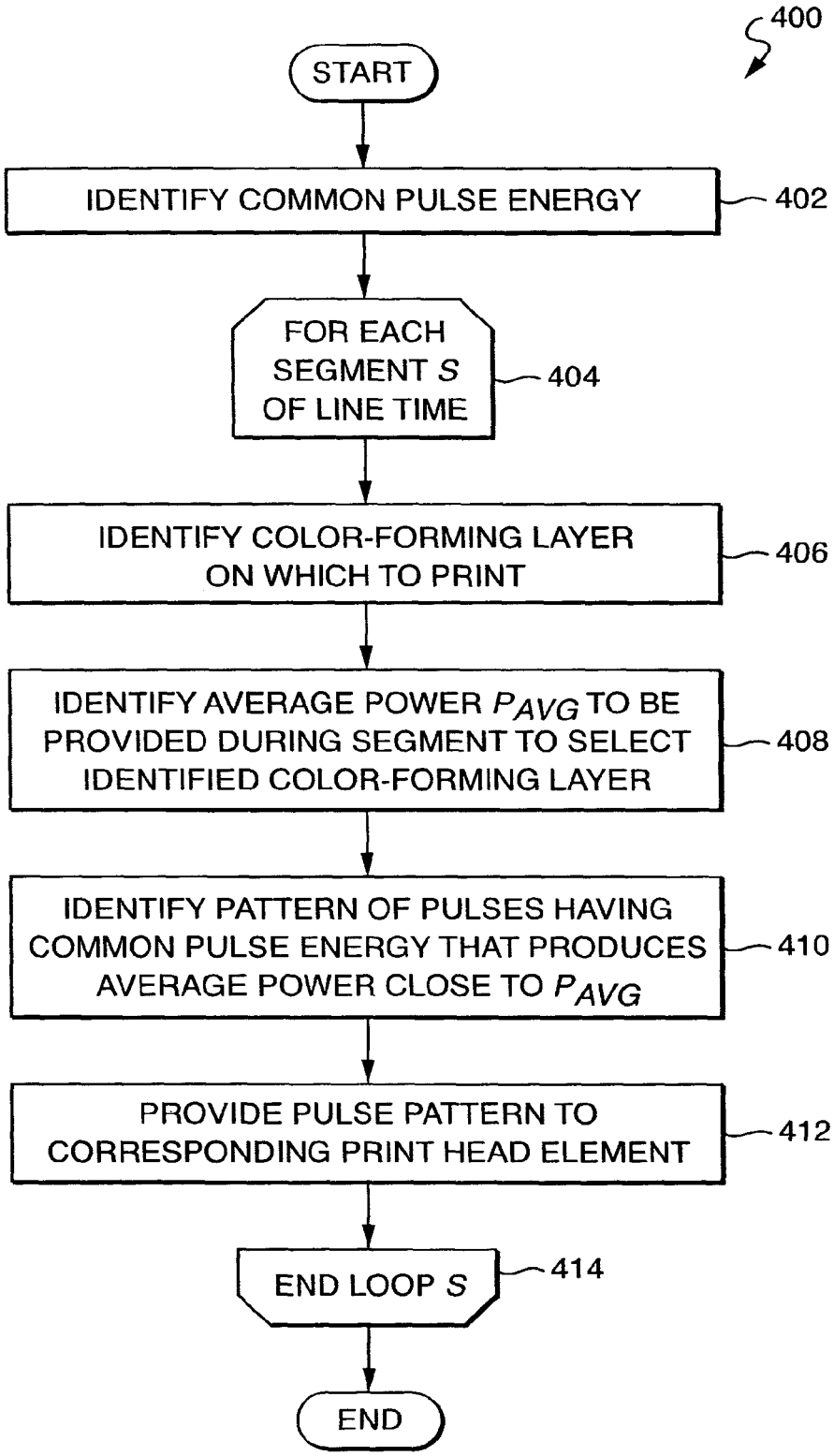
FIG. 4A is a flowchart of a method that is performed by a printer to select a pattern of pulses to provide to a print head element to select a particular color to print according to one embodiment of the present invention.

Referring to FIG. 4A, a flowchart is shown of a method 400 that is performed by the printer 1600 in one embodiment of the present invention to apply the techniques described above when producing output on the output medium 1608. Those having ordinary skill in the art will appreciate how to implement the method 400 as part of a method for printing a digital image on the output medium 1608.

The method 400 identifies a common energy for all pulses (step 402). Recall, for example, that the pulses 310*a-h* in FIG. 3 all have the same energy.

The method 400 enters a loop over each segment S in a line interval (step 404). For example, referring again to FIG. 3, the first segment may be segment 308*a* and the second segment may be segment 308*b*. The method 400 identifies the color-forming layer of the output medium 1608, corresponding to the segment S, on which to print (step 406).

The method 400 identifies an average power $P_{AVG}$ to be provided to a corresponding print head element during segment S to select the color-forming layer identified in step 406 (step 408). Techniques for performing step 408 are disclosed, for example, in the above-referenced patent application entitled "Thermal Imaging System."

The method 400 identifies a pattern of pulses that produces (approximately) the average power $P_{AVG}$, subject to the constraint that each of the pulses has the common energy identified in step 402 (step 410). Note that any pattern satisfying the specified constraints may be selected in step 410. The pulse pattern may be a pattern that only occupies subintervals in a designated "on-time" portion of a segment, such as on-time portion 312*a* or 312*b* in FIG. 3. The pulse pattern identified in step 410 may occupy all of the subintervals in the corresponding segment portion (as in the case of the pulses 310*a-d* in segment portion 312*a*) or fewer than all of the subintervals in the corresponding segment portion (as in the case of the pulses 310*e-h* in segment portion 312*b*). Those having ordinary skill in the art will appreciate that other kinds of patterns may also satisfy the specified constraints.

Since the average power $P_{AVG}$ varies from color-forming layer to color-forming layer, the pulse pattern selected in step 410 for a first color-forming layer will differ from the pulse pattern selected in step 410 for a second color-forming layer, as a result of the constraint that pulses in the patterns have the same energy. In particular, such pulse patterns will differ in the fraction of subintervals that contain pulses, as illustrated by the example in FIG. 3.

The method 400 provides the identified pulse pattern to the corresponding print head element to select the color-forming layer identified in step 406 and therefore to print the appropriate color (step 412). The method 400 repeats steps 406-412 for the remaining segment(s) in the line interval (step 414).

Note that although in the example illustrated in FIG. 3, a pulse is provided in all four subintervals 306*a-d* of the first segment portion 312*a*, and in one out of every four of the subintervals 306*h-w* in the second segment portion 312*b*, pulses may be provided with any frequency and in any pattern. For typical applications, pulsing one out of every N subintervals in the second segment portion 312*b* will produce satisfactory results, where N ranges from 2 to 20. Similarly, although in the example illustrated in FIG. 3 pulses are provided in a single contiguous set of subintervals 306*a-d* at the beginning of the first segment 308*a*, this is not required. Furthermore, the pulsing pattern for each segment may either remain constant or change from line time to line time, and/or from print head element to print head element, within a single line time.

It should be appreciated, in accordance with the teachings of the above-referenced patent applications, that each of the segments 308*a-b* may correspond to a different color to be printed. For example, the pulses 310*a-d* provided in the first segment 308*a* may be used to print on a yellow image-forming layer of the print medium 1608, while the pulses 310*e-h* provided in the second segment 308*b* may be used to print on a cyan image-forming layer of the same print medium 1608.

In the example illustrated in FIG. 3, pulses 310*e-h* are issued regularly in one out of every four of the subintervals 306*e-t*. This is a special case of what is referred to herein as "1-out-of-N" pulsing, in which N=4. In the case of N=1, pulses are provided in every subinterval and the maximum average power $P_{MAX}$ is obtained.

It may appear to be a limitation of the techniques disclosed above that 1-out-of-N pulsing does not allow the selection of an arbitrary value for the average power. That is to say, 1-out-of-2 pulsing reduces the average power by 2 (i.e., to $P_{MAX}/2$), 1-out-of-3 pulsing reduces the average power by 3 (i.e., $P_{MAX}/3$), and in general 1-out-of-N pulsing reduces power by N (i.e., to $P_{MAX}/N$). Solely using 1-out-of-N pulsing, therefore, does not allow for reduction of average power to values other than $P_{MAX}/N$ for single integral values of N. If finer adjustment is desired, it may be obtained using any of a variety of techniques involving the issuance of more irregular pulse streams.

Figure 5:
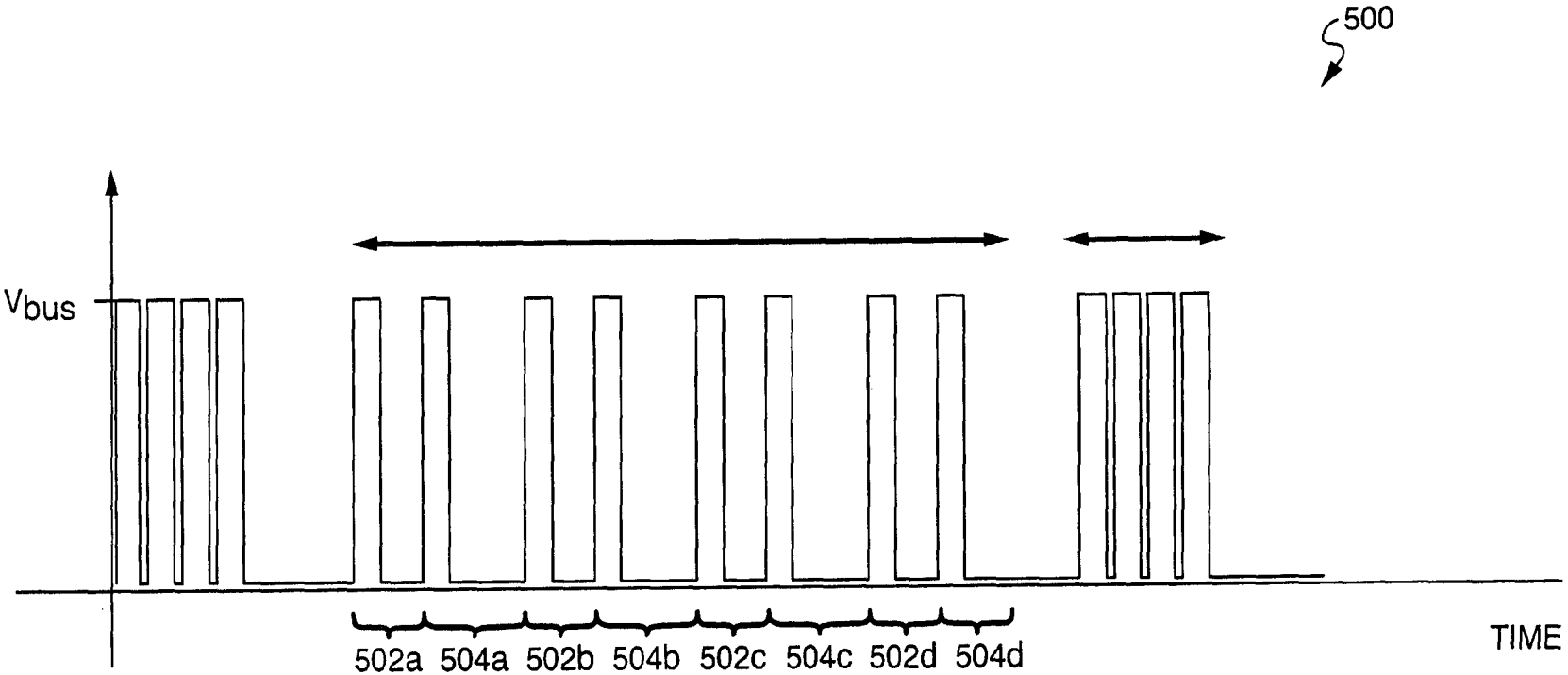
FIG. 5 is a graph of a pulse stream that alternates between 1-out-of-2 and 1-out-of-3 pulsing according to one embodiment of the present invention.

For example, in one embodiment of the present invention, 1-out-of-N pulsing is used, but the value of N may vary within a line interval. Referring to FIG. 5, for example, a graph 500 is shown of a pulse stream that alternates between 1-out-of-2 (N=2) pulse intervals 502*a-d* and 1-out-of-3 (N=3) pulse intervals 504*a-d*. This alternating pattern of pulses will achieve an average power level of 2-out-of-5 times $P_{MAX}$ (40%), which is intermediate between 1-out-of-2 (50%) and 1-out-of-3 (33%).

Techniques may be applied to obtain other desired average power levels. Let $P_{AVG}$ be the desired average power level. For example, consider a case in which it is desired to obtain an average of 38%, i.e., in which $P_{AVG}=0.38P_{max}$. Since 38% is intermediate between 1-out-of-2 (50%) and 1-out-of-3 (33%), the pulse rate may be restricted to a choice between 1-out-of-3 pulses and 1-out-of-2 pulses (i.e., in which N is restricted to be equal to either 2 or 3). This can be accomplished by keeping track of the average power so far, and applying the following rule: if the average power so far is above the target power of $0.38P_{max}$, then the next pulse sequence should be 1-out-of-3, so as to lower the average; if the average power so far is below the target power, then the next sequence should be 1-out-of-2, so as to raise the average.

Assume, for example, that the first pulse sequence uses 1-out-of-2 pulsing. The result of applying the above-described rule in this case is illustrated by the graph 600 in FIG. 6 and by Table 1, below. At the end of the first two subintervals, the average power will be $0.50P_{max}$. Since this is higher than the target of $0.38P_{max}$, a 1-out-of-3 pulsing sequence may be chosen for the next three subintervals. After this sequence is complete, the average duty cycle has been reduced to 2-out-of-5 or $0.40P_{max}$, which is still above the target of $0.38P_{max}$. Therefore, another 1-out-of-3 pulsing sequence may be selected for following three subintervals, after which the total average duty cycle will be 3-out-of-8, or $0.375P_{max}$.

Continued application of this technique can bring the average duty cycle closer to the target value of $0.38P_{max}$. The result achieved in this example is shown in Table 1.

| Sequence | Net Percent of $P_{max}$ | Net Error (%) |
|---|---|---|
| 1-of-2 | 50 | 31.6 |
| 1-of-3 | 40 | 5.3 |
| 1-of-3 | 37.5 | −1.3 |
| 1-of-2 | 40 | 5.3 |
| 1-of-3 | 38.5 | 1.2 |
| 1-of-3 | 37.5 | −1.3 |
| 1-of-2 | 38.9 | 2.3 |
| 1-of-3 | 38.1 | 0.2 |

Note that the set of pulse sequences shown in Table 1 is not necessarily perfectly repetitious. After the sequence of twenty-one subintervals shown in Table 1, eight pulses have been issued with a net fraction of 8/21, or $0.381P_{max}$, which is very close to the desired target of $0.38P_{max}$. Note also that the benefits of such averaging may only be obtained if averaging is performed over a time interval shorter than the thermal relaxation time of the print head.

Figure 4B:
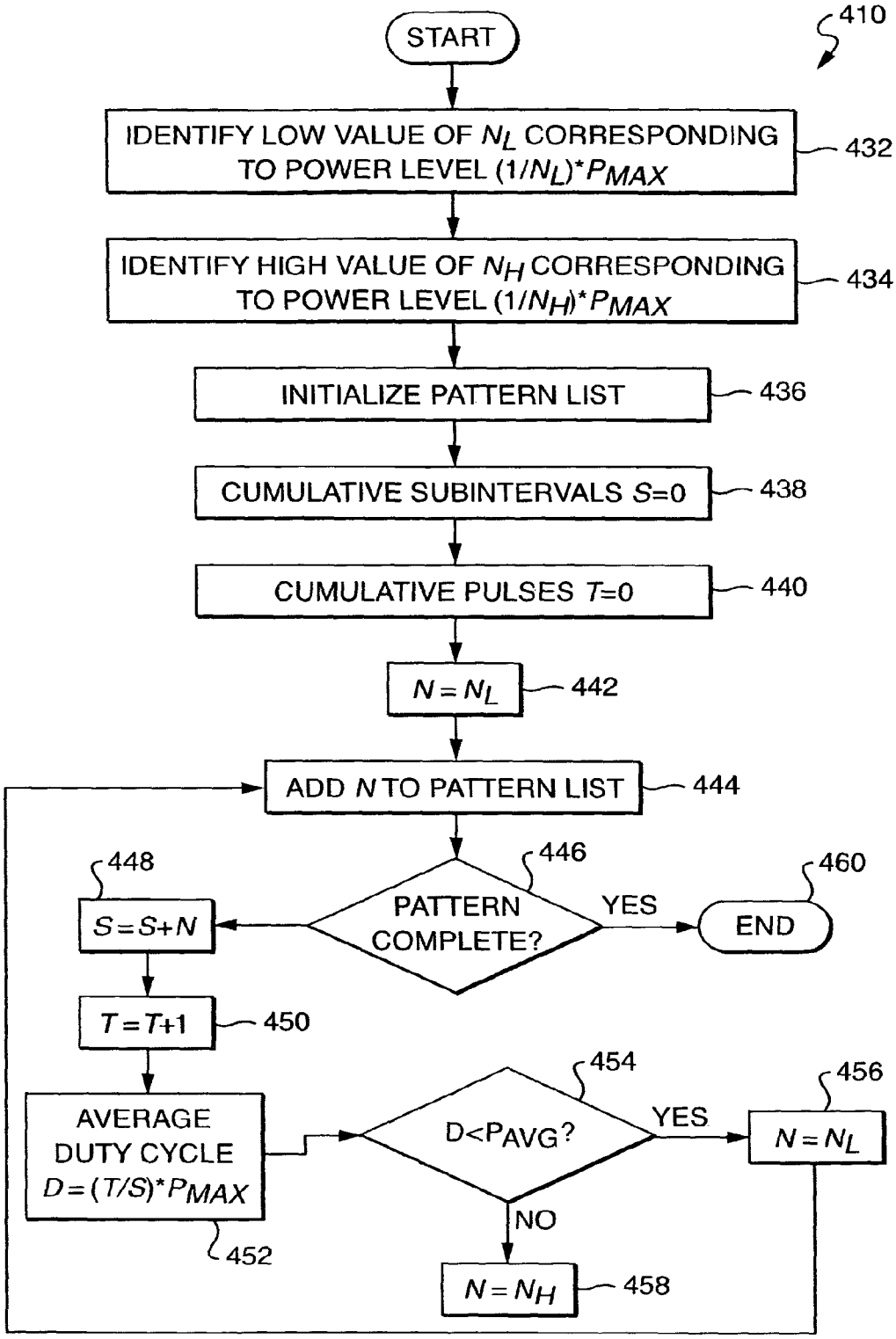
FIG. 4B is a flowchart of a method that is used by the method of FIG. 4A to select a pattern of pulses for use in a portion of a segment of a line time according to one embodiment of the present invention.

Referring to FIG. 4B, a flowchart is shown of a method that is performed in one embodiment of the present invention to implement step 410 (FIG. 4A) using the technique described above for obtaining desired power levels which cannot be obtained merely by 1-out-of-N pulsing with a single value of N. The method identifies a low value $N_L$ corresponding to a power level of $(1/N_L)*P_{MAX}$ that is above the target power $P_{AVG}$ (step 432). In the example provided above, $N_L=2$. The method identifies a high value $N_H$ corresponding to a power level of $(1/N_H)*P_{MAX}$ that is below the target power $P_{AVG}$ (step 434). In the example provided above, $N_H=3$. In one embodiment of the present invention, $N_H$ and $N_L$ are chosen such that $N_H=N_L+1$, and such that $(1/N_H)*P_{MAX}<P_{AVG}<(1/N_L)*P_{MAX}$.

The method initializes a "pattern list" to an empty list (step 436). A pattern list is a representation of a sequence of values of N that are used in a pulse pattern. For example, the pattern list (2,3) indicates a pattern in which a 1-out-of-2 (N=2) pulse sequence is followed by a 1-out-of-3 (N=3) pulse sequence. The method initializes a count S of the cumulative subintervals traversed so far to zero (step 438). Similarly, the method initializes a count T of cumulative pulses included so far to zero (step 440). The method initializes the value of N to $N_L$ (step 442). This choice is arbitrary; N may instead be initialized to the value of $N_H$. It may be advantageous, however, to select $N_L$ as the initial value of N when beginning with a print head at room temperature.

The method adds the current value of N to the pattern list (step 444). Assuming, as in the case of FIG. 6 and Table 1, that N was initialized to a value of 2, the pattern list will be (2) after the first performance of step 444, as indicated by portion 602*a* in FIG. 6 and the first row of the "Sequence" column in Table 1. The method determines whether the pulse pattern is complete, such as by determining whether the required energy has been delivered to the media, or whether the current pulse pattern fills the corresponding segment. If the pattern is complete, the method terminates (step 460).

Otherwise, the method increases the value of S by the current value of N (step 448). In the present example, S=2 after performance of step 448. The method increments the value of T by 1, since one pulse has been added to the current pulse pattern in step 444 (step 450).

The method identifies the average power P in the current segment as $(T/S)*P_{MAX}$ (step 452). In the present example, T=1 and S=2, so the average power is P (½)*P, as indicated in the "Net Percent of $P_{MAX}$" column of the first row of Table 1.

The method determines whether the value of P corresponds to an average power that is less than the value of $P_{AVG}$ identified in step 408 of FIG. 4A (step 454). Assuming that $P_{AVG}=0.38*P_{MAX}$ and $P=0.50*P_{MAX}$, then $P>P_{AVG}$ and the method assigns the value of $N_H$ (i.e., 3) to N (step 458). The method adds the value of N to the pattern list, at which point the pattern list is (2,3), as indicated by portions 602*a-b* in FIG. 6.

Since the pattern is not complete (step 446), the method assigns the value of 5 to S (step 448), and assigns the value of 2 to T (step 450). The average power at this point is therefore ⅖ of $P_{MAX}$ or $0.40*P_{MAX}$, as indicated in the "Net Percent of $P_{MAX}$" column of the second row of Table 1 (step 452). Since this value is still greater than $P_{AVG}$ (0.38), the method assigns the value of $N_H$ (i.e., 3) to N (step 458). The method adds the value of N to the pattern list, at which point the pattern list is (2,3,3), as indicated by portions 602*a-c* in FIG. 6.

If the pattern is not complete (step 446), the method assigns the value of 8 to S (step 448), and assigns the value of 3 to T (step 450). The average power at this point is therefore ⅜ of $P_{MAX}$ or $0.375*P_{MAX}$, as indicated in the "Net Percent of $P_{MAX}$" column of the third row of Table 1 (step 452). Since this value is less than $P_{AVG}$ (0.38), the method assigns the value of $N_L$ (i.e., 2) to N (step 456). The method adds the value of N to the pattern list, at which point the pattern list is (2,3,3,2), as indicated by portions 602*a-d* in FIG. 6.

Figure 6:
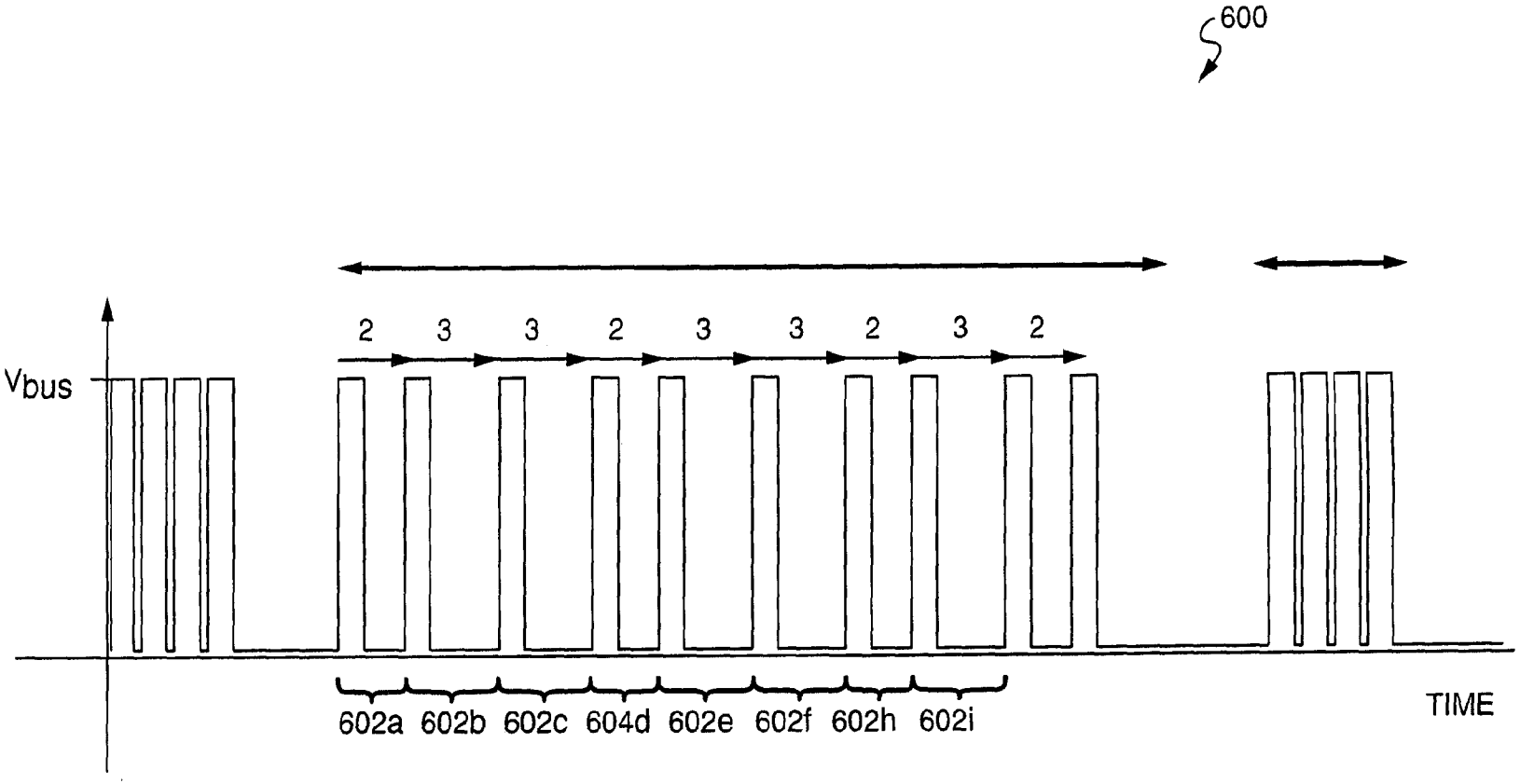
FIG. 6 is a graph of a pulse stream that is produced by the method of FIG. 4B according to one embodiment of the present invention.

It should be appreciated that subsequent iterations of the loop in steps 444-458 produce pulses corresponding to the remaining portions 602*e-i* shown in FIG. 6, until the process terminates (step 446). Population of the segment portion with pulses is then complete, and the method terminates (step 460). It should be appreciated that the same techniques may be applied with any values of $N_H$ and $N_L$ such that $(1/N_H)*P_{MAX}<P_{AVG}<(1/N_L)*P_{MAX}$, with any desired average power $P_{AVG}<P_{MAX}$, and with any number of subintervals, so long as $P_{AVG}$ is a value achievable with adequate accuracy within the thermal time constant of the print head.

In the examples described above, the average power provided to a print head element is varied by varying the pattern of fixed-duration pulses provided to the print head element. As will now be described in more detail, in one embodiment of the present invention pulse patterns are provided to a plurality of print head elements in a manner which reduces the peak power requirements of the print head. Such power requirement reduction may be obtained while obtaining some or all of the benefits provided by the screening techniques disclosed above, such as the ability to obtain relative insensitivity to misregistration among the outputs produced by multiple print heads.

As background, consider, for example, the case in which the pulsing techniques described above are performed without also performing screening. Assume for purposes of example that the line-printing interval is divided into two segments. The first (high-power) segment has 38 subintervals and the second (low-power) segment has 629 subintervals (the last 370 of which are part of the off-time portion of the second segment). During the low-power segment of the line interval, 1-out-of-8 pulsing (N=8) is applied.

Figure 7:
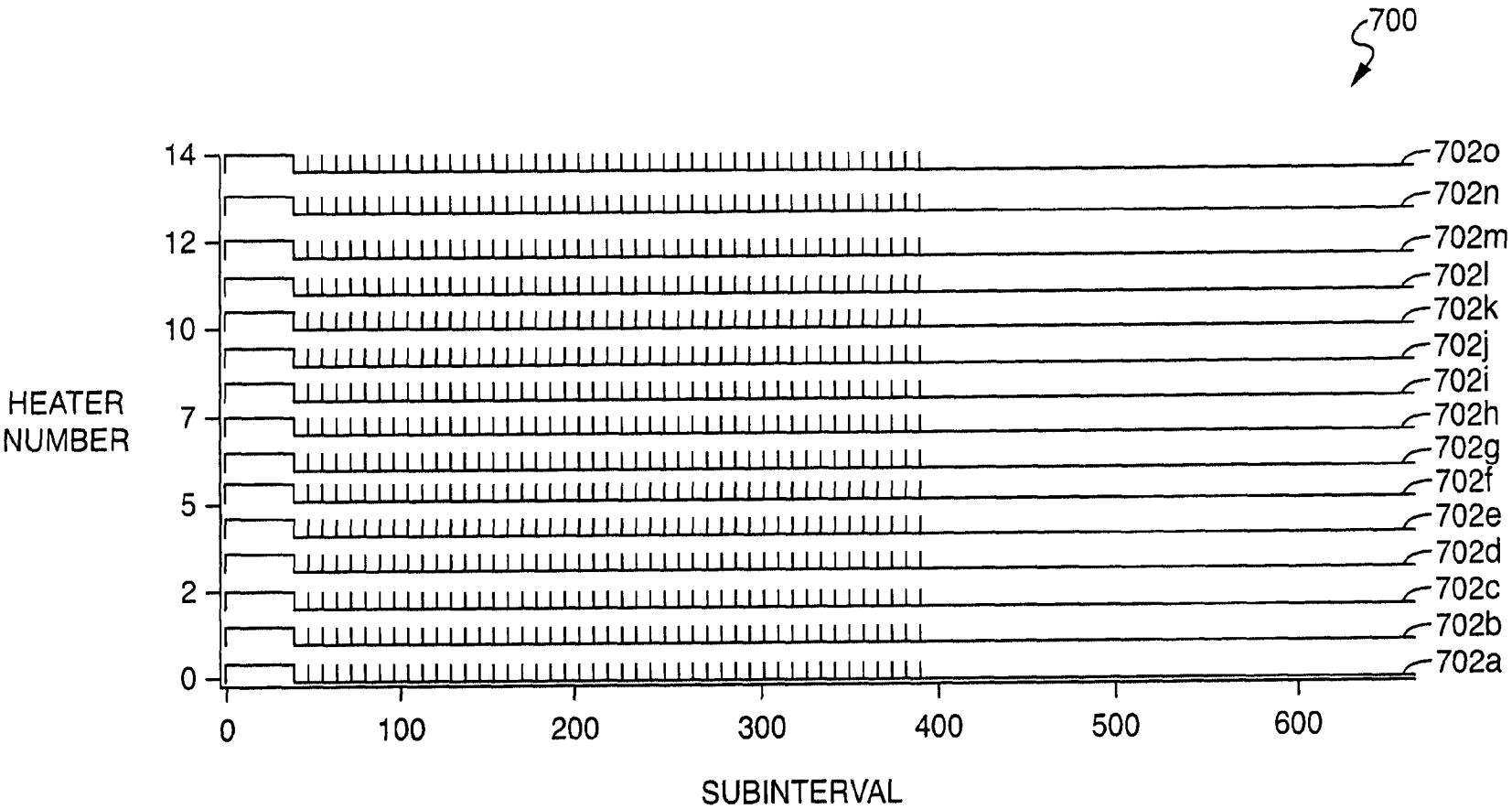
FIG. 7 is a graph including plots of identical in-phase pulses applied to a set of adjacent print head elements in a printer.

Referring to FIG. 7, a graph 700 is shown that includes plots 702*a-o* illustrating the timing of the pulses applied to a set of 15 adjacent print head elements on a thermal print head. Note that, for ease of illustration, FIG. 7 and other drawings may not depict the shape, size, and number of pulses completely accurately. For example, in some cases, the depicted pulses are spaced too closely together to represent with complete accuracy in the drawings. The drawings therefore, should be interpreted as general guides to understanding, rather than as fully accurate depictions of the pulses they represent.

In FIG. 7, for the purposes of illustration, the first segment is filled with the maximum number of pulses, and in this special case there is no off-time portion in this segment. Although the first segment in each line-time is illustrated in FIG. 7 as a single pulse for ease of illustration, the first segment actually includes a plurality of high duty-cycle pulses. Assume that the pulse patterns applied to the remaining heating elements in the print head are the same as those illustrated by plots 702*a-o*.

Figure 8:
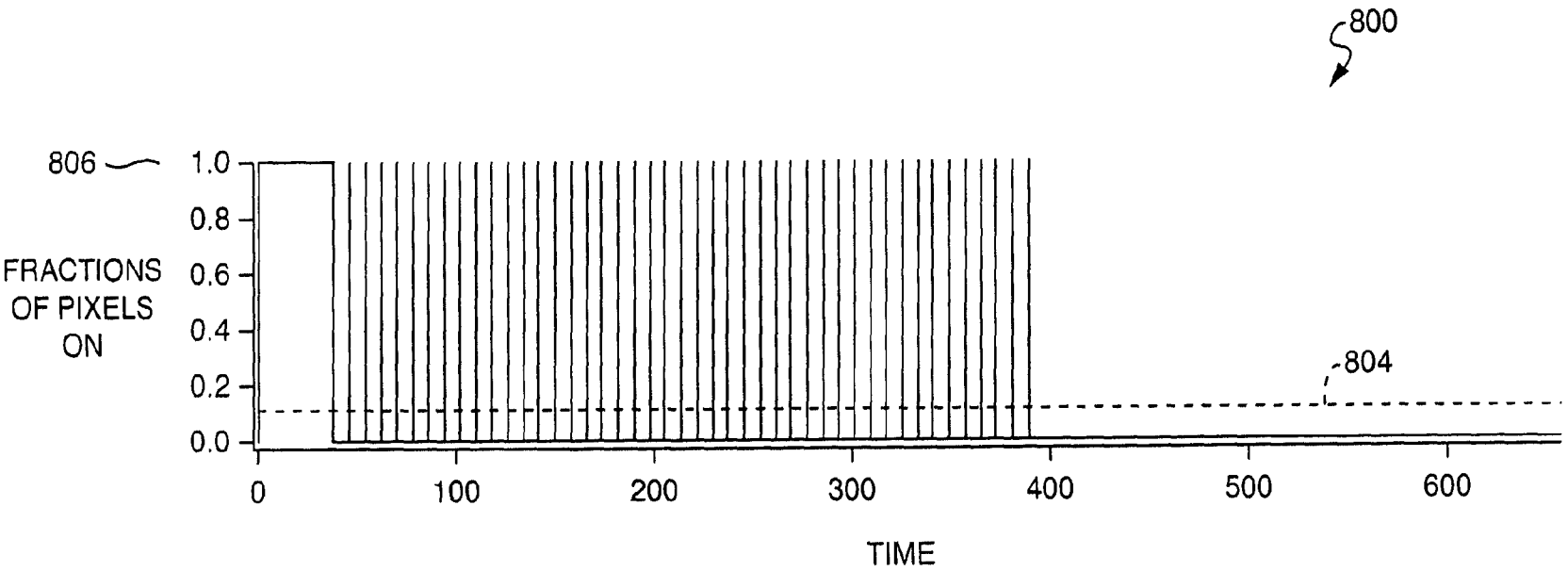
FIG. 8 is a graph of the sum of the pulses illustrated in FIG. 7.

To find the total power in each subinterval, the power applied to all the heaters may be summed by summing the plots for all of the pixels in the thermal print head. To the extent that the plots 702*a-o* are representative of a repeating pattern in the thermal print head, the average power may be identified by averaging the plots 702*a-o*. The result, shown in graph 800 in FIG. 8, is normalized by the power delivered when all the heaters are on simultaneously. The peak power $P_{MAX}$ 806 in the graph 800, therefore, is equal to 1.0. Also shown in FIG. 8, as a dashed line 804, is the power averaged over the line-printing interval.

It is evident from FIG. 8 that the average power 804 and the peak power 806 are quite different. This difference has an effect on the properties of the power supply required to operate the printer 1602. In particular, although the average power 804 required of the power supply is relatively low, there are many instants in the printing cycle where the power demand is much higher. Ordinarily, the power supply may be chosen to satisfy the "worst case" demands represented by the peak power 806. This will typically add to the size and cost of the power supply.

In one embodiment of the present invention, the required size of the power supply is reduced by distributing power more evenly over the line-printing interval to decrease peak power consumption. For example, the power may be distributed more evenly over the line-printing interval by varying the pulse sequences that are applied to the print head elements so as to reduce the sum of the pulse signals applied to the print head elements at any point in time.

Figure 9:
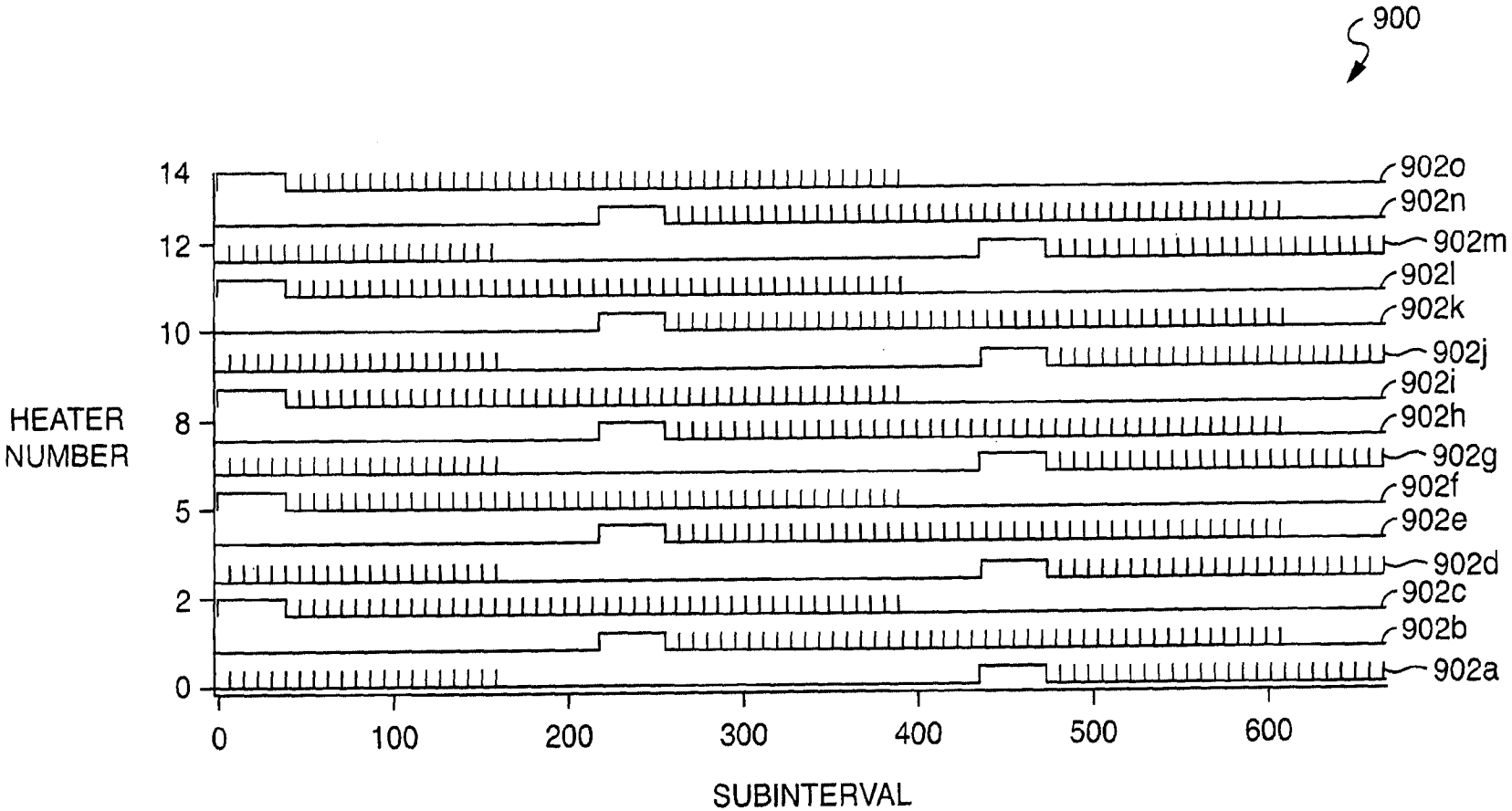
FIG. 9 is a graph including plots of pulses to which a three-phase screening has been applied according to one embodiment of the present invention.
Figure 10:
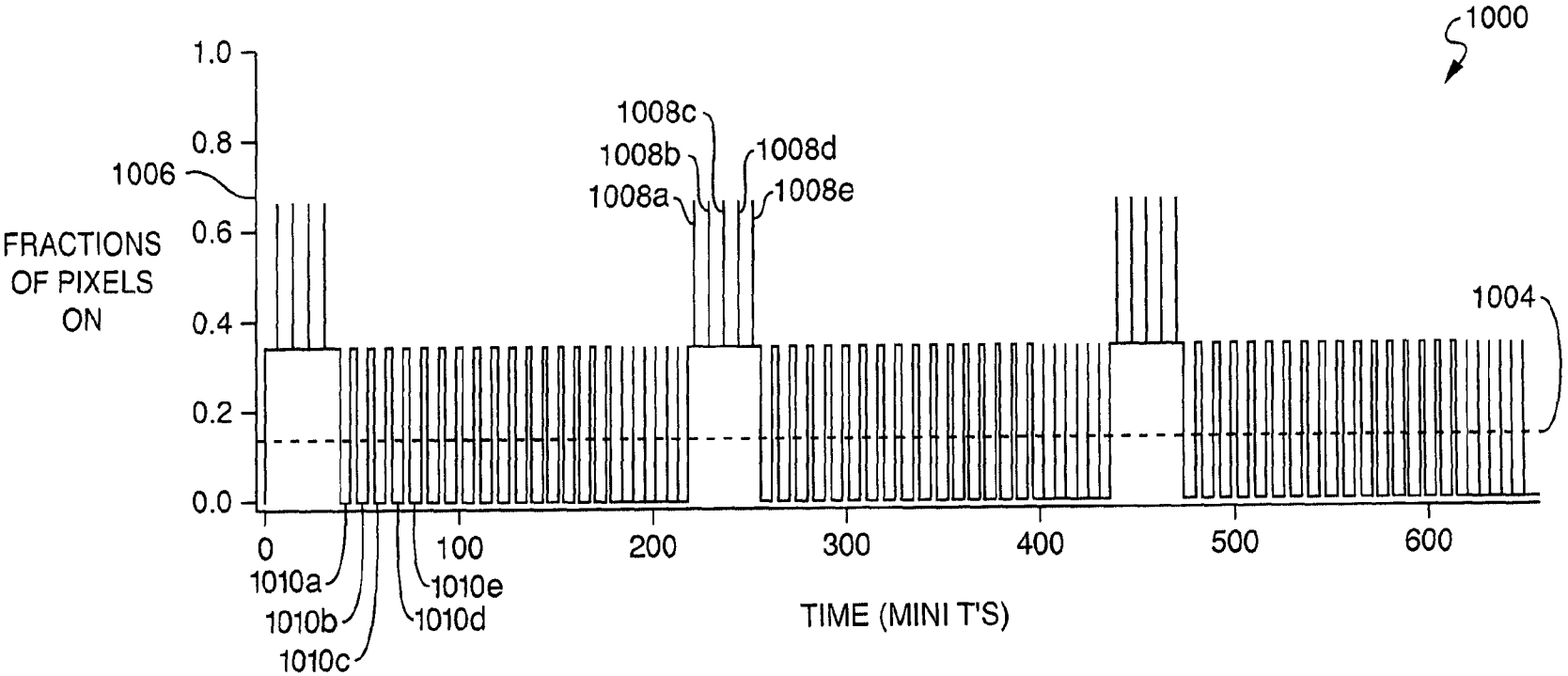
FIG. 10 is a graph of the sum of the pulses illustrated in FIG. 9.

In one embodiment of the present invention, the pulse sequences are varied using time shifts, but without otherwise varying the pulse patterns. Consider, for example, a three phase screening, in which the pulse patterns 902*a-o* applied to the first 15 pixels are as shown in FIG. 9. Note that the pulse patterns 902*a-o* alternate between three identical patterns. Note also that the number of traces used in the simulations should be a multiple of the number of phases in order for the average result to accurately represent the average result for the entire print head. In particular, patterns 902*a*, 902*d*, 902*g*, 902*j*, and 902*m* are the same as each other; patterns 902*b*, 902*e*, 902*h*, 902*k*, and 902*n* are the same as each other; and patterns 902*c*, 902*f*, 902*i*, 902*l*, and 902*o* are the same as each other. Pattern 902*b* is the same as pattern 902*a* except for a time shift; pattern 902*c* is the same as pattern 902*b* except for a time shift; and so on. Referring to FIG. 10, a graph 1000 is shown illustrating the normalized total power to the print head in the case of the pulsing patterns 902*a-o* shown in FIG. 9.

As may be seen by comparing FIG. 10 to FIG. 8, although the average power 1004 in FIG. 10 is the same as the average power 804 in FIG. 8, the peak power has been reduced from level 806 (FIG. 8) to level 1006 (FIG. 10). This represents a reduction in peak power of 33%, and thereby reduces the power supply requirements for the printer 1602. As may be seen from FIG. 10, however, some subintervals (such as subintervals 1008*a-e*) still have relatively high power requirements, while in other subintervals (such as subintervals 1010*a-e*), no power is used. Therefore, there is still opportunity to further distribute power throughout the line time and therefore to further reduce the power supply requirements.

The example illustrated in FIG. 9 decreases the peak power of the print head using three unique time delays. Typically there is no advantage to using a number of time delays that is greater than the ratio of the total number of subintervals to the number of subintervals in the first segment. In addition to or instead of the time shifts described above, the peak power requirement may be reduced by shifting the pulse patterns by additional small amounts to remove timing coincidences among the low-power segment pulses in different print head elements.

Figure 11A:
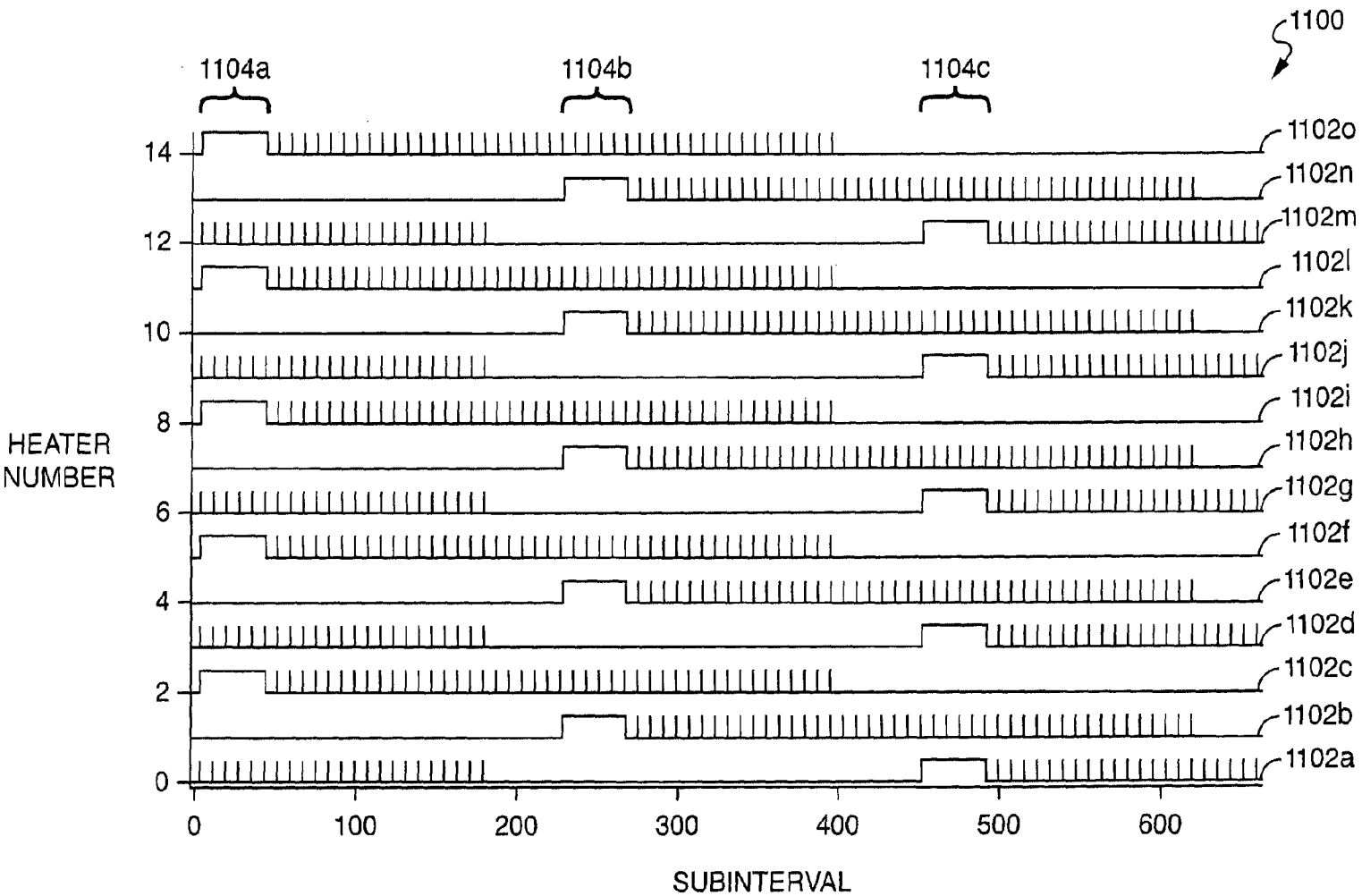
FIG. 11A is a graph including plots of pulses resulting from adding additional delays to the pulses of FIG. 9 according to one embodiment of the present invention.
Figure 11B:
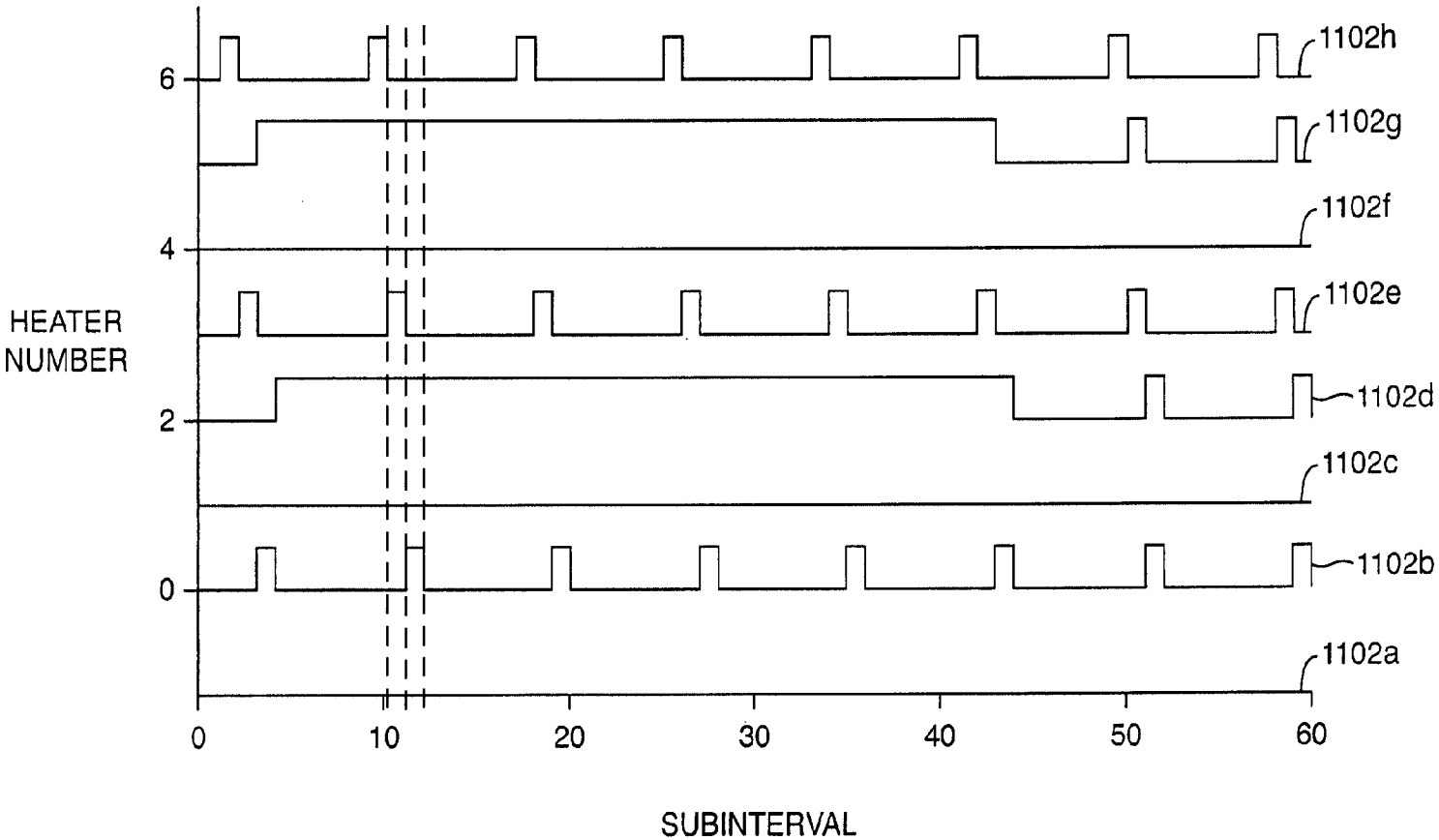
FIG. 11B is a graph showing an enlarged view of a portion of the plots shown in FIG. 11A.
Figure 12:
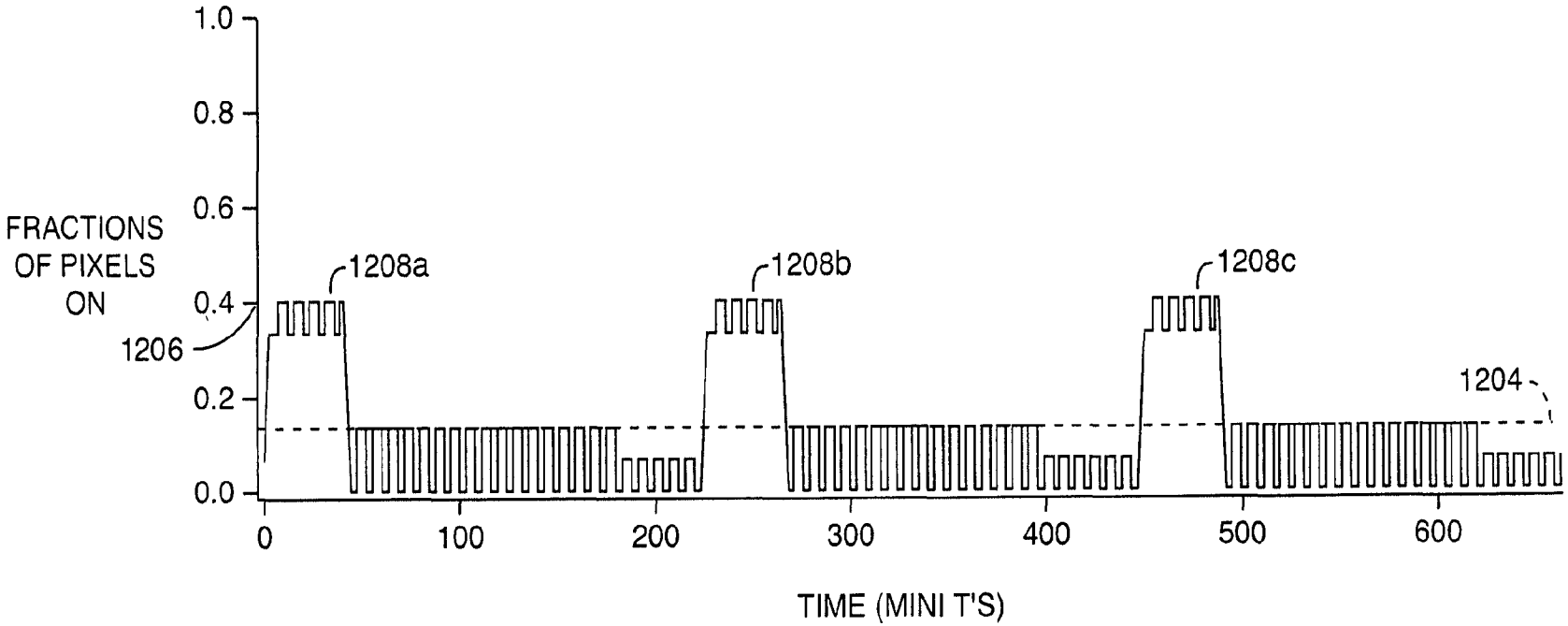
FIG. 12 is a graph of the sum of the pulses illustrated in FIG. 11A.

Referring to FIG. 11A, a graph 1100 is shown illustrating an alternate set of pulsing patterns 1102*a-o* according to one embodiment of the present invention. In this embodiment, and as shown more clearly in FIG. 11B, heaters 3-5 are delayed by an extra subinterval to avoid coincidence of their low-power pulses with the low-power pulses of heaters 0-2. Similarly, heaters 6-8 are delayed by an extra 2 subintervals to avoid coincidence with either heaters 0-2 or heaters 3-5. Subsequent heaters repeat this set of three pulse patterns. The aggregate power across all heating elements is illustrated by graph 1200 in FIG. 12. Note that the average power 1204 remains the same as in the previous cases, but that the peak power 1206 has been further reduced in comparison to the peak power 806 in FIG. 8, to a value that is 40% of its original value 906.

The remaining peaks 1208*a-c* are largely a result of the coincidence of high-power intervals in regions 1104*a-c* (FIG. 11A) and may be addressed by using a screening pattern with a larger number of distinct time delays. The largest number of distinct delays that may be used is determined by the ratio of the line-printing time to the high-power printing time. In the present example, this ratio is 667 subintervals/38 subintervals=17.5. Therefore, in the present example, as many as 17 distinct time delays may be used in an attempt to reduce the peak power requirement.

Figure 1:
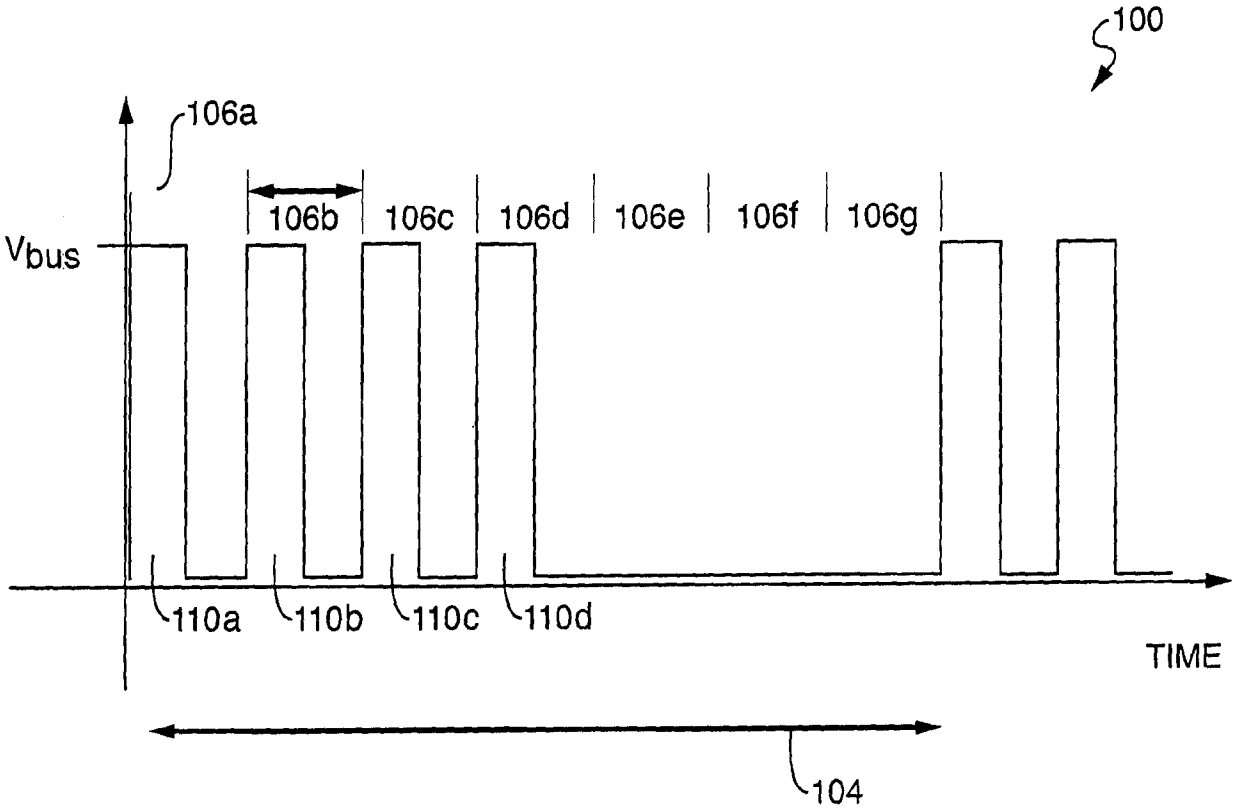
FIG. 1 is a graph that shows the voltage across a print head element over time in a printer in which the line time is divided into a plurality of subintervals.
Figure 2:
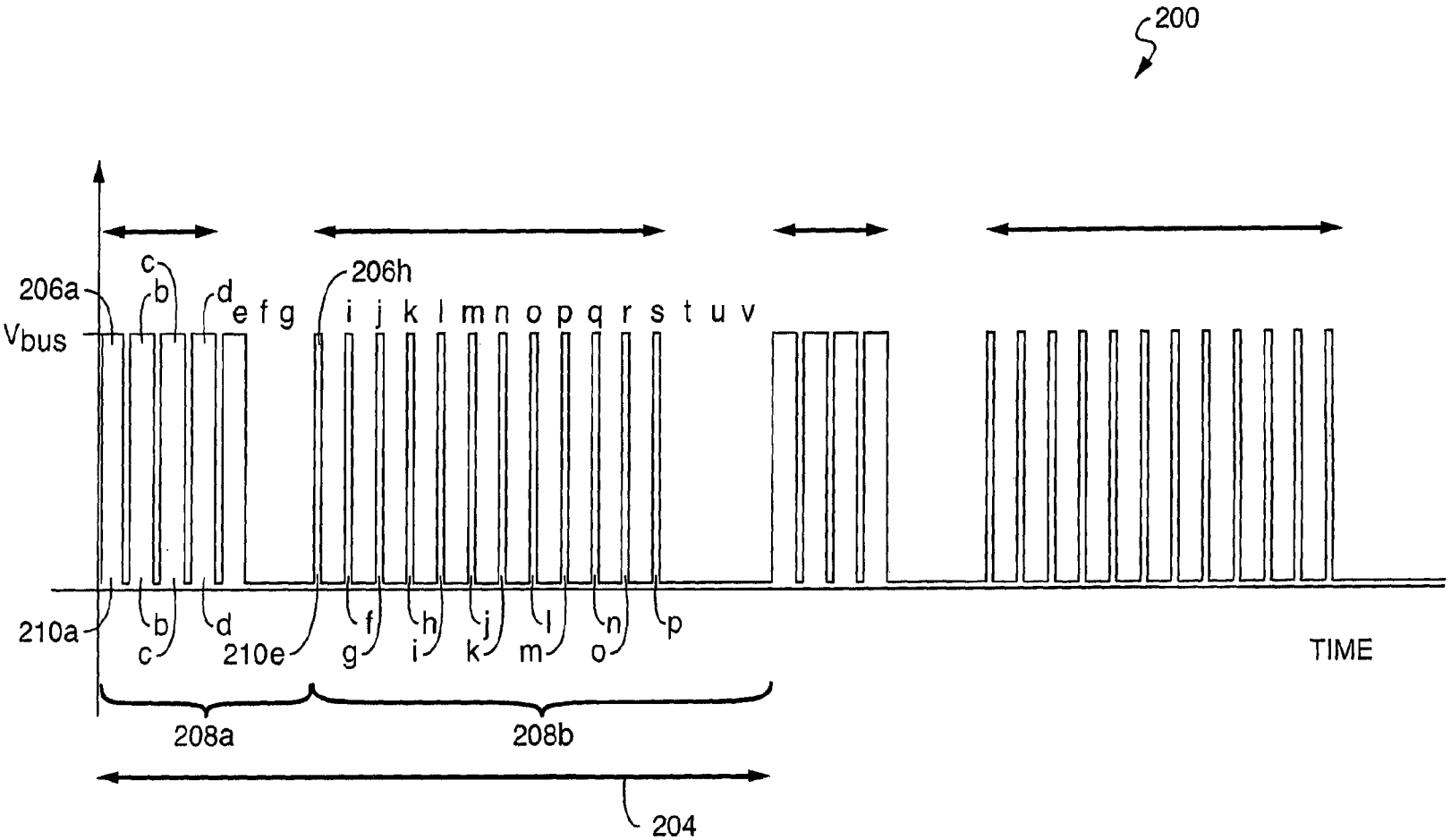
FIG. 2 is a graph that shows the voltage across a print head element over time in a printer in which the line time is divided into two segments, each of which is divided into a plurality of subintervals.
Figure 13A:
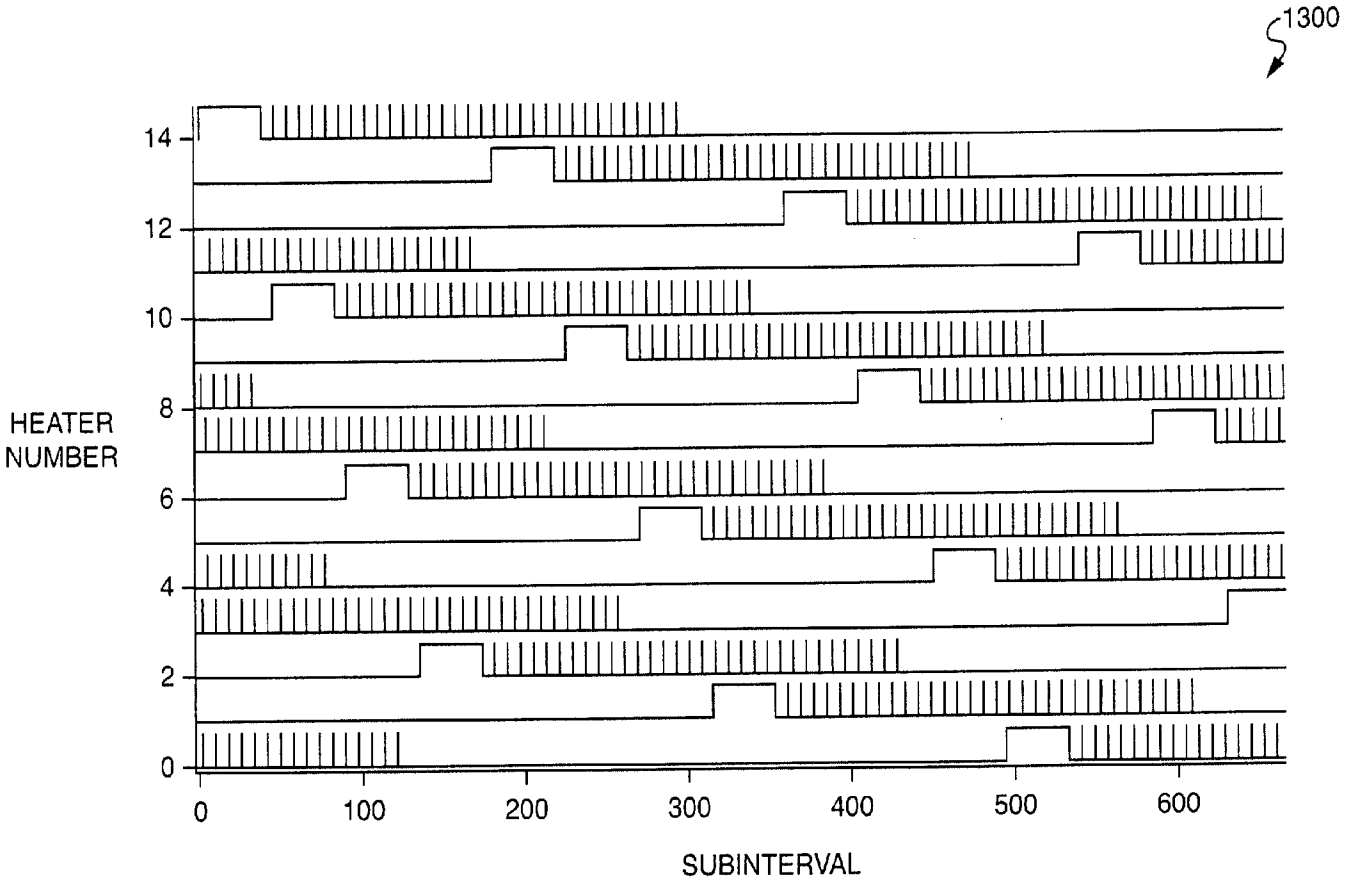
FIG. 13A is a graph including plots of pulses to which a 15-phase screening and additional delays have been applied according to one embodiment of the present invention.
Figure 13B:
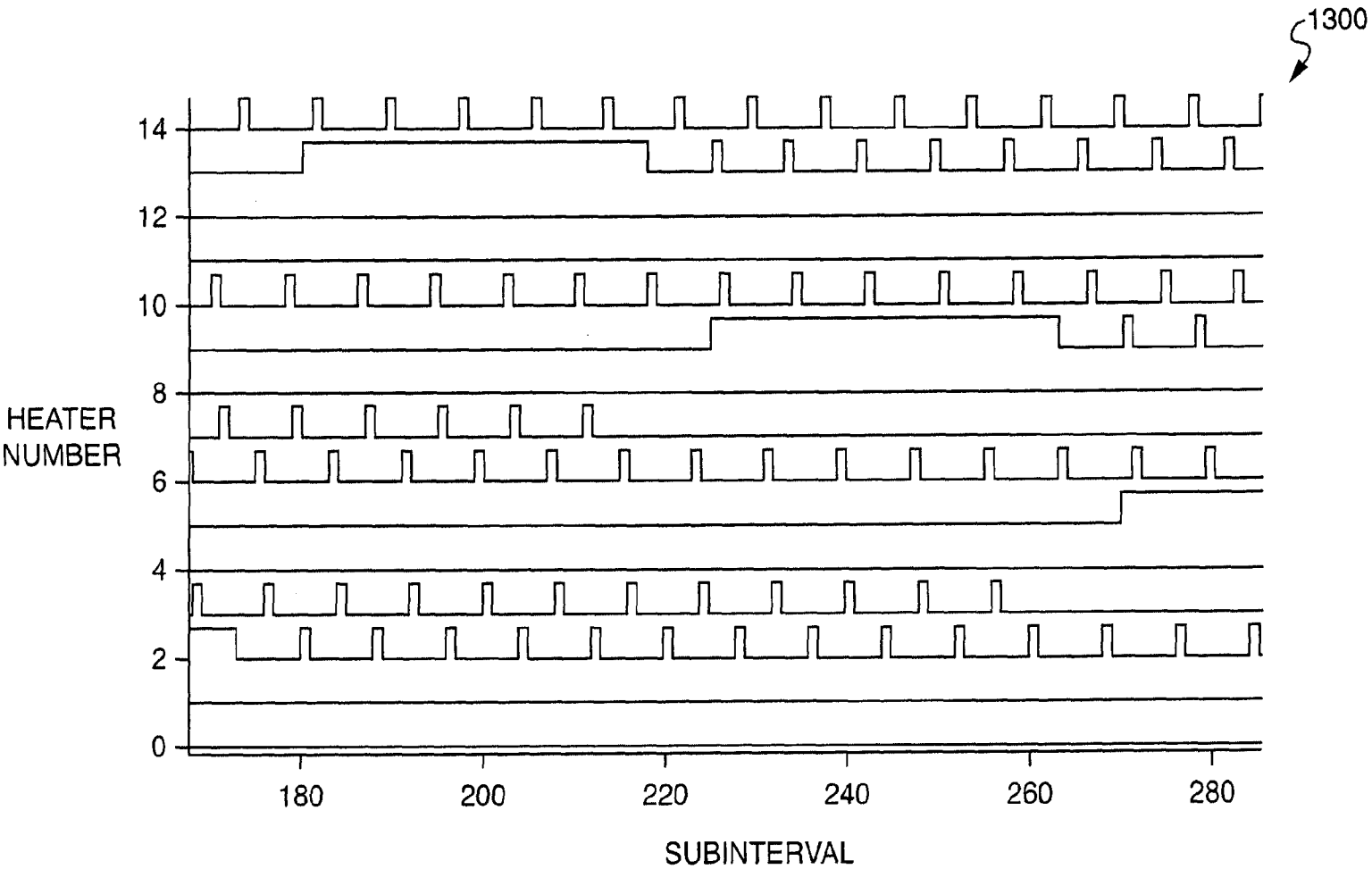
FIG. 13B is a graph showing an enlarged view of a portion of the plots shown in FIG. 13A.

In the present example, peak power may be further reduced, for example, by using a screening with different delays for each of the 15 heater pulse patterns. In one particular example illustrated in FIG. 13A, 1-out-of-8 pulsing is used in the low-power segment, and time delays of 45 subintervals are used. Note that although in the particular example illustrated in FIG. 13A, and as shown more clearly in FIG. 13B, there are 15 different delays that are used in a particular order, these delays may be applied in any order. Heaters beyond number 14 repeat the same sequence of pulse patterns.

To those skilled in the art, it will be apparent that the introduction of time delays into the pulse streams applied to each heater will result in slight shifts of the locations at which the corresponding pixels are printed. These shifts are less than the pixel spacing, and in general are difficult to see. However, the repeating pattern of the shifts is sometimes detectable. For example straight horizontal lines in the image take on a slight serrated pattern that may be visible in some contexts. To counteract such patterns, the image may be resampled to find interpolated image values corresponding to the points at which pixels will actually be printed. For example, if it is known that a pixel will be subjected to a time delay of one-half of a line time, then this pixel may be replaced with an interpolated value corresponding to the position halfway between the original pixel position and the next down-web pixel position. When the image data are resampled in this way, the printed image will be largely free of visible serration artifacts from the time delays.

Figure 14:
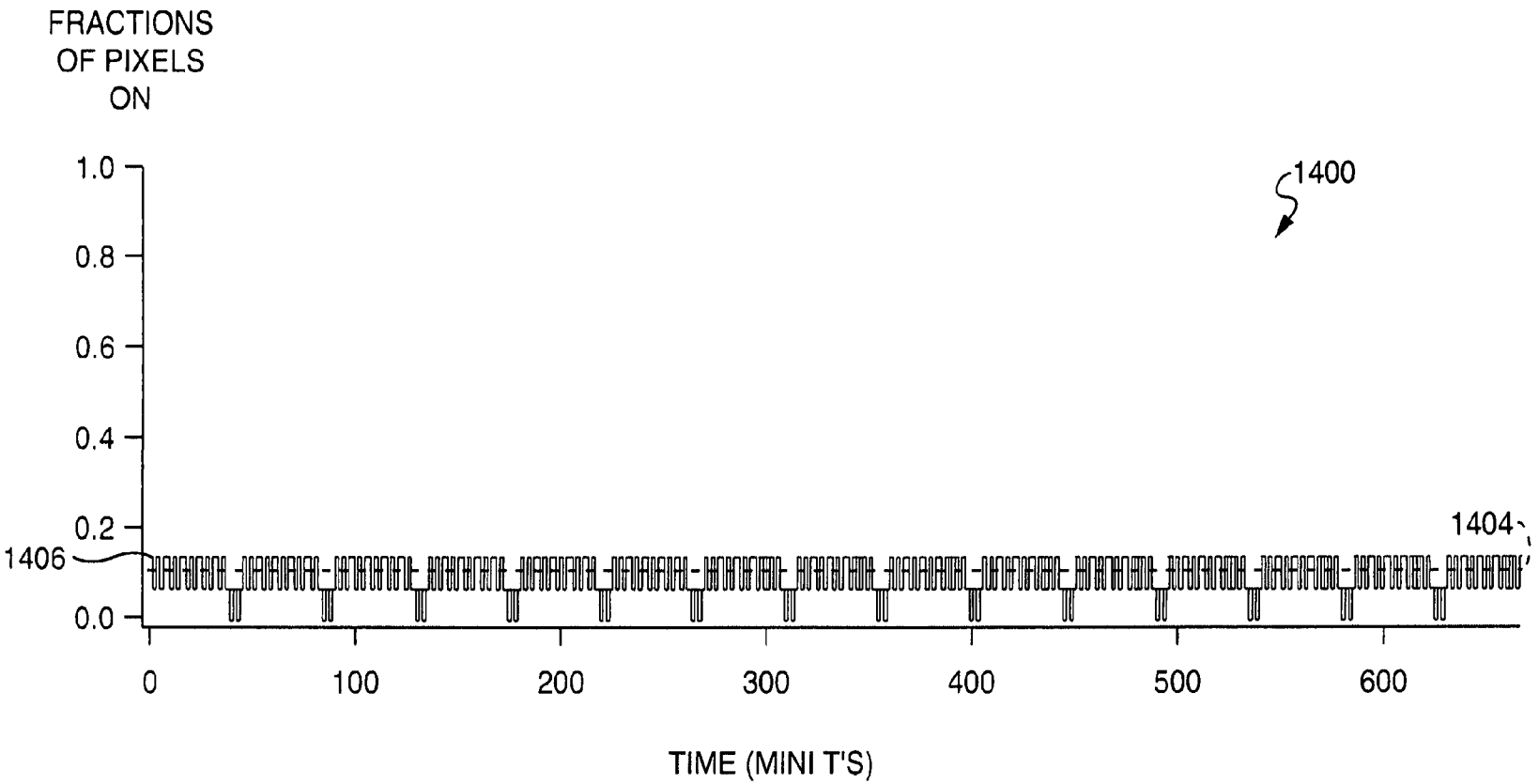
FIG. 14 is a graph of the sum of the pulses illustrated in FIG. 13A.

Referring to FIG. 14, a graph 1400 illustrating the normalized total power to the print head is shown in the case of the pulse patterns illustrated in FIG. 13. As may be seen from FIG. 14, the peak power 1406 (0.133) has almost been reduced to the average power 1404 (0.125). Furthermore, the power supply now supplies nearly constant power with only minor demand for higher peak power.

In general, the steps that may be taken in accordance with embodiments of the present invention to reduce power demands are not inconsistent with the types of screening patterns that result in tolerance for misregistration. For example, those having ordinary skill in the art will appreciate how to apply the power reduction techniques just described to the screening techniques disclosed in the above-referenced patent application entitled "Image Stitching for a Multi-Head Printer."

Various examples of techniques have been described for reducing the peak power requirement on the print heads 1604*a-b*. More generally, the peak power requirement may be reduced in accordance with various aspects of the invention by any of the following techniques, either singly or in any combination: (1) choosing the number of time delays to be near to, but less than, the ratio of the line-printing time to the high-power segment length, but with enough "slack" to allow the time delays to be additionally advanced or delayed by one or more subintervals; (2) choosing the time delays to divide the line-printing interval nearly equally, so that the high-power segments do not overlap between any two time-delayed pulse patterns; and (3) considering any remaining power peaks that result from coincidences between the low-power segment pulses for different phases and adjustment, if necessary, of the time delays to reduce or eliminate those coincidences as much as possible. It should be noted that if there are 1-out-of-N pulses activated in the low-power segments, there is only a range of N subintervals for adjustment, and if the number of time delays exceeds N, then some overlap of low-power segment pulses is unavoidable.

Figure 15:
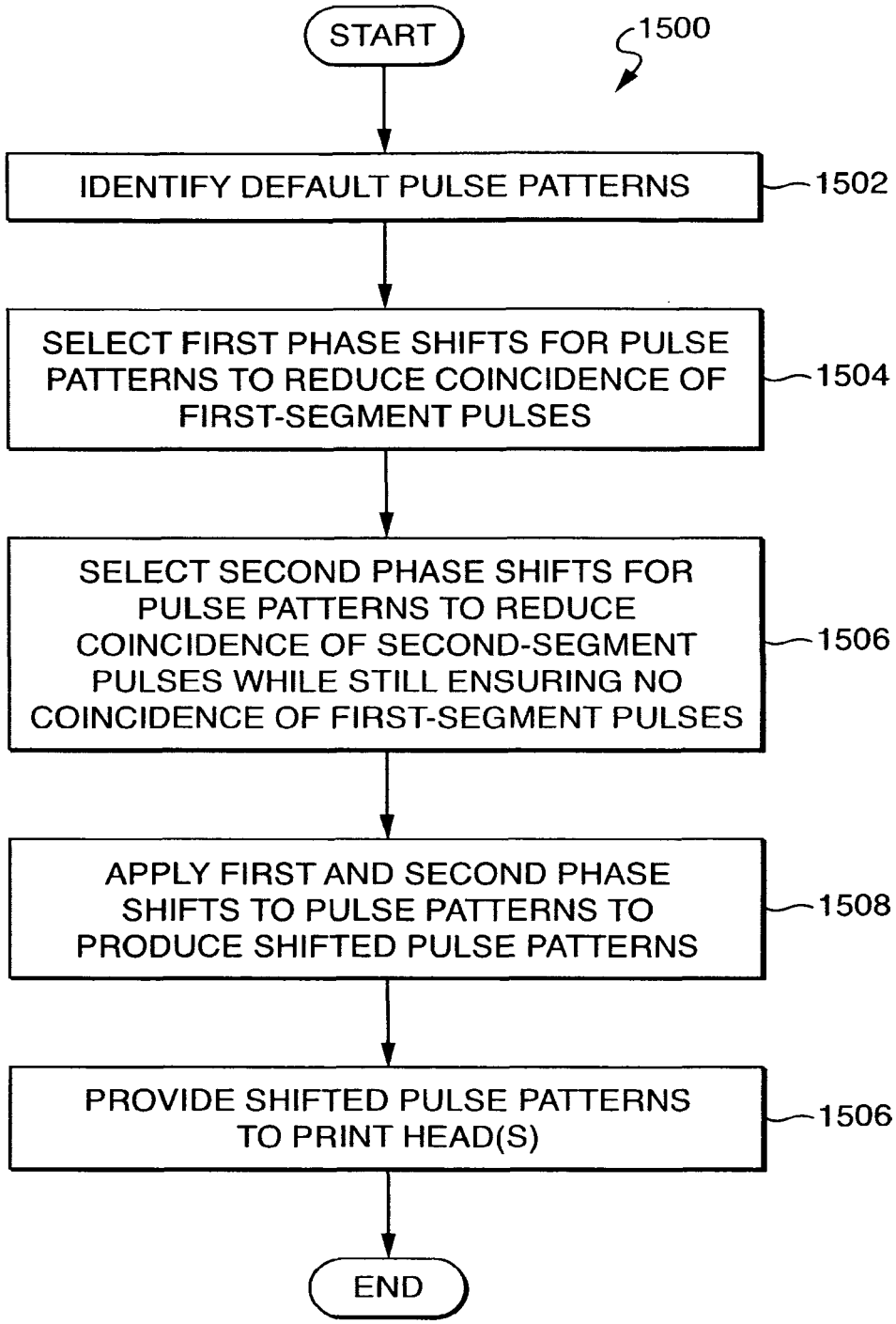
FIG. 15 is a flowchart of a method that is performed to reduce the peak power requirement of a print head according to one embodiment of the present invention.

For example, referring to FIG. 15, a flowchart is shown of a method 1500 that may be performed to reduce the peak power requirement of the printer 1602 Default pulse patterns are identified (step 1502). The pulse patterns 702*a-o* shown in FIG. 7, all of which are synchronized with each other, are examples of such default pulse patterns.

The method 1500 selects a first set of time shifts to apply to the default pulse patterns to reduce the coincidence of high-power segment pulses with each other (step 1504). The shifted pulse patterns 902*a-o* shown in FIG. 9 are examples of pulse patterns which have been shifted to reduce the coincidence of high-power segment pulses with each other.

The method 1500 selects a second set of time shifts to apply to the first shifted pulse patterns to reduce coincidence of low-power segment pulses (step 1506). The pulse patterns 1102*a-o* shown in FIG. 11A are examples of pulse patterns which have been shifted to reduce the coincidence of low-power segment pulses with each other.

The method applies the first and second time shifts to the default pulse patterns to produce a set of shifted pulse patterns (step 1508). The method provides the shifted pulse patterns to one or more print heads to produce the desired output (step 1506).

Returning to FIGS. 13-14, there is no coincidence of low-power segment pulses for the first 8 phases; therefore all unique offsets of the low-power segment pulses are used in the example of FIGS. 13-14, in which 1-out-of-8 pulsing is used. With 15 different phases and only 8 unique offsets of low-power segment pulses it is not possible entirely to avoid overlaps of low-power segment pulses in different phases. However, it is possible to achieve the optimum case in which there are no more than two phases in each subinterval having coincident low-power segment pulses.

It is to be understood that although the invention has been described above in terms of particular embodiments, the foregoing embodiments are provided as illustrative only, and do not limit or define the scope of the invention. Various other embodiments, including but not limited to the following, are also within the scope of the claims. For example, elements and components described herein may be further divided into additional components or joined together to form fewer components for performing the same functions.

Note that although in the examples described above, all of the individual pulse duty cycles are set to a single value which may be close to 100%, the common duty cycle may be lower if required by the print head specification, or if desired for some other reason.

Figure 16:
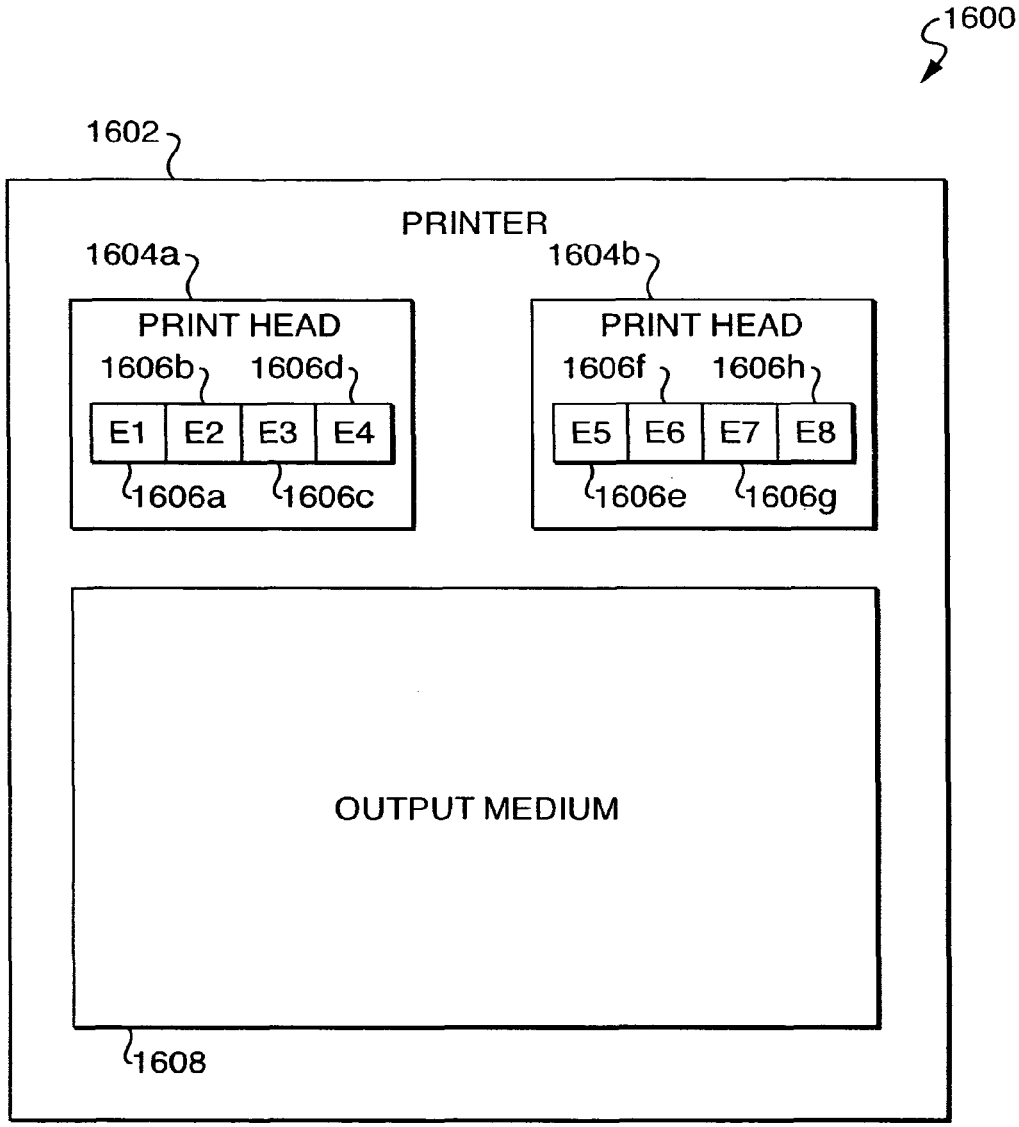
FIG. 16 is a block diagram of a printing system according to one embodiment of the present invention.

Note that although a particular printer 1602 having a particular number of print heads 1604*a-b* and a particular number of print head elements 1606*a-h* is shown in FIG. 16, this is merely an example and does not constitute a limitation of the present invention. Rather, embodiments of the present invention may be used in conjunction with various kinds of printers having various numbers of print heads, print head elements, and other characteristics.

U.S. Pat. No. 6,661,443 to Bybell and Thornton describes a method for providing the same amount of energy to each active element in a thermal print head during each subinterval used to print an image irrespective of the number of print head elements that are active during each subinterval. The desired amount of energy may be provided to a plurality of print head elements that are active during a print head cycle by delivering power to the plurality of print head elements for a period of time whose duration is based in part on the number of active print head elements. The period of time may be a portion of the print head cycle. According to one embodiment of the present invention, the pulse duty cycle is changed from subinterval to subinterval, implementing a so-called "common mode voltage correction" by varying the pulse duration in response to the change in voltage caused by the change in the number of active print head elements, thereby maintaining a constant energy for all pulses.

The techniques described above may be implemented, for example, in hardware, software, firmware, or any combination thereof. The techniques described above may be implemented in one or more computer programs executing on a programmable computer including a processor, a storage medium readable by the processor (including, for example, volatile and non-volatile memory and/or storage elements), at least one input device, and at least one output device. Program code may be applied to input entered using the input device to perform the functions described and to generate output. The output may be provided to one or more output devices.

Figure 17:
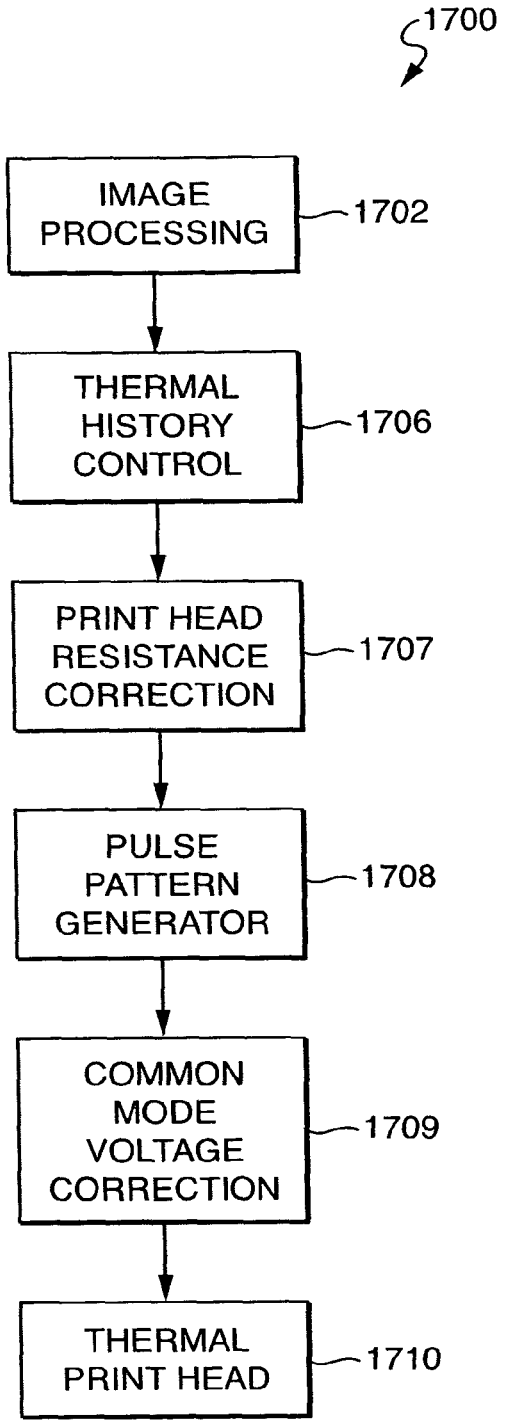
FIG. 17 is a block diagram of an image processing and pulse generation portion of the printing system of FIG. 16 according to one embodiment of the present invention.

For example, the techniques disclosed herein may be implemented in a printer or other device having components for performing the functions illustrated by the system 1700 in FIG. 17. An image processing unit 1702 receives raw print data and performs initial image processing, such as decompression. The process print data are provided to a thermal history control engine 1704, which performs thermal history control on the print data as described, for example, in the above-referenced patent application entitled "Thermal Imaging System." The output of the thermal history control engine 1704 is provided to a print head resistance correction engine 1706, which performs corrections on the print data as described, for example, in the above-referenced patent application entitled "Method and Apparatus for Controlling the Uniformity of Print Density of a Thermal Print Head Array." The output of the print head resistance correction engine 1706 is provided to a pulse pattern generator 1708, which generates pulses in accordance with the techniques disclosed herein. The pulses generated by the pulse pattern generator 1708 are provided to a common mode voltage correction engine 1709, which performs common mode voltage correction on the pulses as described, for example, in the above-referenced patent application entitled, "Method and Apparatus for Voltage Correction." The output of the common mode voltage correction engine 1709 is provided the thermal print head 1710 to pulse the print head 1710 accordingly.

Each computer program within the scope of the claims below may be implemented in any programming language, such as assembly language, machine language, a high-level procedural programming language, or an object-oriented programming language. The programming language may, for example, be a compiled or interpreted programming language.

Each such computer program may be implemented in a computer program product tangibly embodied in a machine-readable storage device for execution by a computer processor. Method steps of the invention may be performed by a computer processor executing a program tangibly embodied on a computer-readable medium to perform functions of the invention by operating on input and generating output. Suitable processors include, by way of example, both general and special purpose microprocessors. Generally, the processor receives instructions and data from a read-only memory and/or a random access memory. Storage devices suitable for tangibly embodying computer program instructions include, for example, all forms of non-volatile memory, such as semiconductor memory devices, including EPROM, EEPROM, and flash memory devices; magnetic disks such as internal hard disks and removable disks; magneto-optical disks; and CD-ROMs. Any of the foregoing may be supplemented by, or incorporated in, specially-designed ASICs (application-specific integrated circuits) or FPGAs (Field-Programmable Gate Arrays). A computer can generally also receive programs and data from a storage medium such as an internal disk (not shown) or a removable disk. These elements will also be found in a conventional desktop or workstation computer as well as other computers suitable for executing computer programs implementing the methods described herein.

What is claimed is:

1. A direct thermal printer comprising:

a thermal print head comprising a plurality of heating elements;

a control circuit connected to the thermal print head that applies:

(i) a first pulse pattern to a first subset of the plurality of heating elements at a first start time, and (ii) a second pulse pattern to a second subset of the plurality of heating elements at a second start time;

wherein the first start time and second start time differ from each other, whereby the sum of the first pulse pattern and second pulse patterns has a peak power that is less than the peak power obtained by summing the first pulse pattern with itself.

2. The direct thermal printer of claim 1, wherein the first pulse pattern and second pulse pattern are provided in a plurality of subintervals, and wherein the first start time and second start time differ by a multiple of subintervals.

3. The direct thermal printer of claim 1, wherein the first pulse pattern and second pulse pattern each comprise a plurality of pulses with a common predetermined amplitude.

4. The direct thermal printer of claim 1, wherein the first pulse pattern and second pulse pattern each comprise a plurality of pulses with a common predetermined duration.

5. The direct thermal printer of claim 4, wherein the first pulse pattern and second pulse pattern are provided in a plurality of subintervals and a portion of the first pulse pattern and second pulse pattern comprise a plurality of nonconsecutive subintervals with a period of N, where N>1, and wherein the first start time and second start time differ by less than N.

6. The direct thermal printer of claim 1, wherein the first pulse pattern and second pulse pattern comprise a first plurality of pulses having a first average power and a second plurality of pulses having a second average power that differs from the first average power.

7. The direct thermal printer of claim 6, wherein the first plurality of pulses of the first pulse pattern and second pulse pattern are provided to the corresponding plurality of heating elements in a first portion of the printing time, and wherein the second plurality of pulses of the first pulse pattern and second pulse pattern are provided to the corresponding plurality of heating elements in a second portion of the printing time.

8. The direct thermal printer of claim 7, wherein the first plurality of pulses are provided to the heating elements in the first portion of the printing time to produce output having a first color, and wherein the second plurality of pulses are provided to the heating elements in the second portion of the printing to produce output having a second color that differs from the first color.

9. The direct thermal printer of claim 8, wherein the first portion of the printing time is less than the second portion of the printing time.

10. The direct thermal printer of claim 1, wherein the control circuit has a single strobe signal to produce the first plurality of pulses and the second plurality of pulses.

11. A method of reducing peak power while printing onto different color forming layers of a multicolor thermal imaging member using a thermal print head, comprising:

providing, by a control circuit of a direct thermal printer, to a first subset of a plurality of heating elements of a thermal print head of the direct thermal printer, a first pulse pattern at a first start time; and providing, by the control circuit, to a second subset of the plurality of heating elements of the thermal print head, a second pulse pattern at a second start time, the second start time differing from the first start time such that the sum of the first pulse pattern and second pulse patterns has a peak power that is less than the peak power obtained by summing the first pulse pattern with itself.

12. The method of claim 11, wherein the first pulse pattern and second pulse pattern are provided in a plurality of subintervals, and wherein the first start time and second start time differ by a multiple of subintervals.

13. The method of claim 11, wherein the first pulse pattern and second pulse pattern each comprise a plurality of pulses with a common predetermined amplitude.

14. The method of claim 11, wherein the first pulse pattern and second pulse pattern each comprise a plurality of pulses with a common predetermined duration.

15. The method of claim 14, further comprising providing the first pulse pattern and second pulse pattern in a plurality of subintervals, and wherein and a portion of the first pulse pattern and second pulse pattern comprise a plurality of non-consecutive subintervals with a period of N, where N>1, and wherein the first start time and second start time differ by less than N.

16. The method of claim 11, wherein the first pulse pattern and second pulse pattern comprise a first plurality of pulses having a first average power and a second plurality of pulses having a second average power that differs from the first average power.

17. The method of claim 16, further comprising providing the first plurality of pulses of the first pulse pattern and second pulse pattern during a first portion of the printing time, and providing the second plurality of pulses of the first pulse pattern and second pulse pattern in a second portion of the printing time.

18. The method of claim 17, further comprising producing, by the direct thermal printer via the first plurality of pulses provided to the plurality of heating elements, output having a first color; and producing, by the direct thermal printer via the second plurality of pulses provided to the plurality of heating elements, output having a second color different from the first color.

19. The method of claim 18, wherein the first portion of the printing time is less than the second portion of the printing time.

20. The method of claim 11, wherein providing the first pulse pattern and the second pulse pattern comprise providing the first pulse pattern and the second pulse pattern via a single strobe signal of the control circuit.

* * * * *